US006234156B1

(12) United States Patent
Muto

(10) Patent No.: US 6,234,156 B1
(45) Date of Patent: May 22, 2001

(54) METHOD AND APPARATUS FOR CONTROLLING AIR-FUEL RATIO IN ENGINES

(75) Inventor: Harufumi Muto, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/372,753

(22) Filed: Aug. 11, 1999

(30) Foreign Application Priority Data

Sep. 3, 1998 (JP) ..... 10-249742

(51) Int. Cl.[7] ..... F02B 75/08
(52) U.S. Cl. ..... 123/698; 123/674; 123/520
(58) Field of Search ..... 123/698, 674, 123/520

(56) References Cited

U.S. PATENT DOCUMENTS

| | | | |
|---|---|---|---|
| 4,831,992 | | 5/1989 | Jundt et al. . |
| 5,257,613 | | 11/1993 | Monda et al. . |
| 5,299,546 | | 4/1994 | Kato et al. . |
| 5,419,302 | | 5/1995 | Abe . |
| 5,423,307 | | 6/1995 | Okawa et al. . |
| 5,507,269 | | 4/1996 | Morikawa . |
| 5,778,865 | | 7/1998 | Tachibana et al. . |
| 5,950,606 | * | 9/1999 | Iida et al. ..... 123/674 |
| 6,047,688 | * | 4/2000 | Duty et al. ..... 123/520 |
| 6,102,018 | * | 8/2000 | Kerns et al. ..... 123/674 |

FOREIGN PATENT DOCUMENTS

| | | |
|---|---|---|
| 2-130240 | 5/1990 | (JP) . |
| 7-63078 | 3/1995 | (JP) . |
| 7-151020 | 6/1995 | (JP) . |
| 7-166978 | 6/1995 | (JP) . |
| 7-293362 | 11/1995 | (JP) . |
| 2-2700128 | 10/1997 | (JP) . |

* cited by examiner

*Primary Examiner*—John Kwon
(74) *Attorney, Agent, or Firm*—Oliff & Berridge, PLC

(57) ABSTRACT

An apparatus for controlling air-fuel ratio in an engine provided with a fuel vapor purging system. The purging system sends the fuel vapor in a fuel tank to an intake passage. The actual air-fuel ratio is computed from the oxygen concentration of the exhaust gas. An electronic control unit (ECU) adjusts the amount of fuel injected from an injector. The ECU sets a feedback correction coefficient FAF to correct the difference between the actual air-fuel ratio and a predetermined target air-fuel ratio. The feedback correction coefficient FAF is feedback controlled. The ECU further considers fluctuations of the air-fuel ratio caused by the purging system in accordance with the operating state and operating history of the engine.

19 Claims, 17 Drawing Sheets

METHOD AND APPARATUS FOR CONTROLLING AIR-FUEL RATIO IN ENGINES

BACKGROUND OF THE INVENTION

The present invention relates to apparatuses for controlling the air-fuel ratio of air-fuel mixtures used during combustion in engines. More particularly, the present invention pertains to learning apparatuses and methods for optimally controlling the air-fuel ratio in engines incorporating purge apparatuses, which burn the fuel vapor in fuel tanks during combustion so that the fuel vapor is prevented from being released into the atmosphere.

Three-way catalysts, which convert engine emissions into harmless emissions, are widely used in automobile engines, the emissions of which are required to be highly purified. A three-way catalyst oxidizes carbon monoxide (CO) and hydrocarbon (HC) and reduces nitrogen oxide ($NO_x$). The threeway catalyst converts carbon monoxide to carbon dioxide ($CO_2$), hydrocarbon to water ($H_2O$) and carbon dioxide ($CO_2$), and nitrogen oxide to oxygen ($O_2$) and nitrogen ($N_2$). For the three-way catalyst to function effectively, the air-fuel ratio of the air-fuel mixture burned in the engine must be in the proximity of the stochiometric air-fuel ratio. That is, the air-fuel ratio must be in an extremely narrow range. Therefore, prior art three-way catalysts require the air-fuel ratio to be controlled with high precision so that the ratio remains stochiometric. Accordingly, the basic fuel injection amount corresponding to the stochiometric air-fuel ratio in each engine operating state (e.g., engine speed and intake air amount) is stored in the form of a map. The air-fuel ratio obtained from the map, or the basic air-fuel ratio, and the stochiometric air-fuel ratio are theoretically equal to each other. However, wear and dimensional tolerances of components related with the air-fuel ratio control, such as airflow meters or injectors, may cause the basic air-fuel ratio to deviate from the stochiometric, or target, air-fuel ratio. Thus, a learning process is carried out to correct such deviation when controlling the air-fuel ratio.

Recent engines employ purge apparatuses to collect the fuel vapor produced in fuel tanks and to prevent the fuel vapor from being released into the atmosphere. The collected fuel vapor is sent to the engine for combustion, or purged.

When controlling the air-fuel ratio in an engine provided with a purge apparatus, the purged volume of the fuel vapor must be taken into consideration.

Air-fuel ratio control that reflects the influence of the purged fuel vapor is generally executed in the following manner. The basic fuel injection amount corresponding to the operating state of the engine (engine speed and intake air amount) is obtained by referring to a map. The fuel injection amount is then adjusted through feedback control so that the stoichiometric air-fuel ratio is obtained. If the basic fuel injection amount and the actual fuel injection amount differ from each other, a correction co-efficient for correcting the fuel injection amount, or an air-fuel ratio correction coefficient, is stored as a learned value. The learning of the air-fuel ratio correction coefficient takes place when the fuel vapor is not being purged, or during purge-off, so that the air-fuel ratio correction coefficient is not affected by the purged fuel vapor.

The fuel injection amount obtained in correspondence with the target air-fuel ratio when fuel vapor is not being purged differs from the fuel injection amount obtained in correspondence with the target air-fuel ratio during purging.

The fuel injection amount difference and the purged amount of fuel vapor in the intake air (i.e., purged rate) are used to compute the concentration of fuel in the fuel vapor, or vapor concentration coefficient, which is stored as a learned value. The product of the purged rate and the vapor concentration coefficient results in a correction coefficient (purge correction coefficient), which reflects the influence of the fuel vapor on the air-fuel ratio. The purge correction coefficient is used to correct the air-fuel ratio. In this manner, air-fuel ratio control is performed by taking into consideration the influence of the fuel vapor.

The frequency of learning the air-fuel ratio correction coefficient must be increased to improve the precision of the air-fuel control. However, the purging of the fuel vapor must be stopped to renew the air-fuel ratio learned correction coefficient. This increases the time during which purging cannot be performed, which may result in insufficient fuel vapor purging. If fuel vapor purging is performed continuously over a long period of time, the number of opportunities for learning the air-fuel ratio correction coefficient decreases. This lowers the accuracy of the learned air-fuel ratio correction coefficient, which lowers the accuracy of the air-fuel ratio control.

Accordingly, for example, Japanese Unexamined Patent Publication No. 7-166978 proposes an air-fuel control apparatus that learns the air-fuel ratio correction coefficient when the fuel concentration of the purged fuel vapor is low. This increases the frequency of learning and therefore increases the accuracy of the air-fuel ratio control.

However, the air-fuel ratio control apparatus proposed in the Japanese patent publication renews the air-fuel ratio correction coefficient assuming that the concentration of the purged fuel vapor is constant. Therefore, if the concentration of the purged fuel vapor changes when the learning process is carried out, the vapor concentration learned before the concentration change is used when correcting the air-fuel ratio. Hence, the concentration change is not reflected in the learning process. As a result, the air-fuel ratio is controlled in accordance with an erroneously learned air-fuel ratio correction coefficient. This decreases the accuracy of the air-fuel ratio control.

SUMMARY OF THE INVENTION

Accordingly, the objective of the present invention is to provide an air-fuel ratio control apparatus that guarantees sufficient fuel vapor purging and high precision air-fuel ratio control.

To achieve the above objective, the present invention provides an air-fuel ratio controller for an internal combustion engine provided with a fuel vapor supply means. The controller controls the air-fuel ratio of an air-fuel mixture to be burned according to the running state of the engine. The engine includes an air intake passage connected to a combustion chamber, in which air flows to the combustion chamber, a fuel tank for storing liquid fuel, an injector for supplying the liquid fuel to the combustion chamber. The fuel vapor supply means supplies fuel vapor vaporized in the fuel tank to the combustion chamber. The controller includes an air-fuel sensor, an air-fuel ratio control means, a primary correcting means, and a secondary correcting means. The air-fuel sensor detects the actual air-fuel ratio of the air-fuel mixture. The air-fuel ratio control means controls at least one of the amount of fuel supplied from the injector and the amount of air flowing in the air intake passage.

The primary correcting means sets a feedback coefficient to correct the difference between the actual air-fuel ratio and a predetermined target air-fuel ratio. The feedback coefficient is feedback controlled. The secondary correcting means employs a change of the air-fuel ratio, which is caused by operation of the fuel vapor supplying means in the operation of the air-fuel ratio control means, to correct the difference between the actual air-fuel ratio and the target air-fuel ratio by cooperating with the primary correcting means. The secondary correcting means judges, by referring the running state and an operating history of the engine, whether to calculate an air-fuel ratio correction coefficient related to the difference between the actual air-fuel ratio and the target air-fuel ratio, to calculate a concentration coefficient related to the fuel concentration of the fuel vapor, to calculate the air-fuel ratio correction coefficient and the concentration coefficient at the same time, or to register the actual air-fuel ratio correction coefficient as a temporary value.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
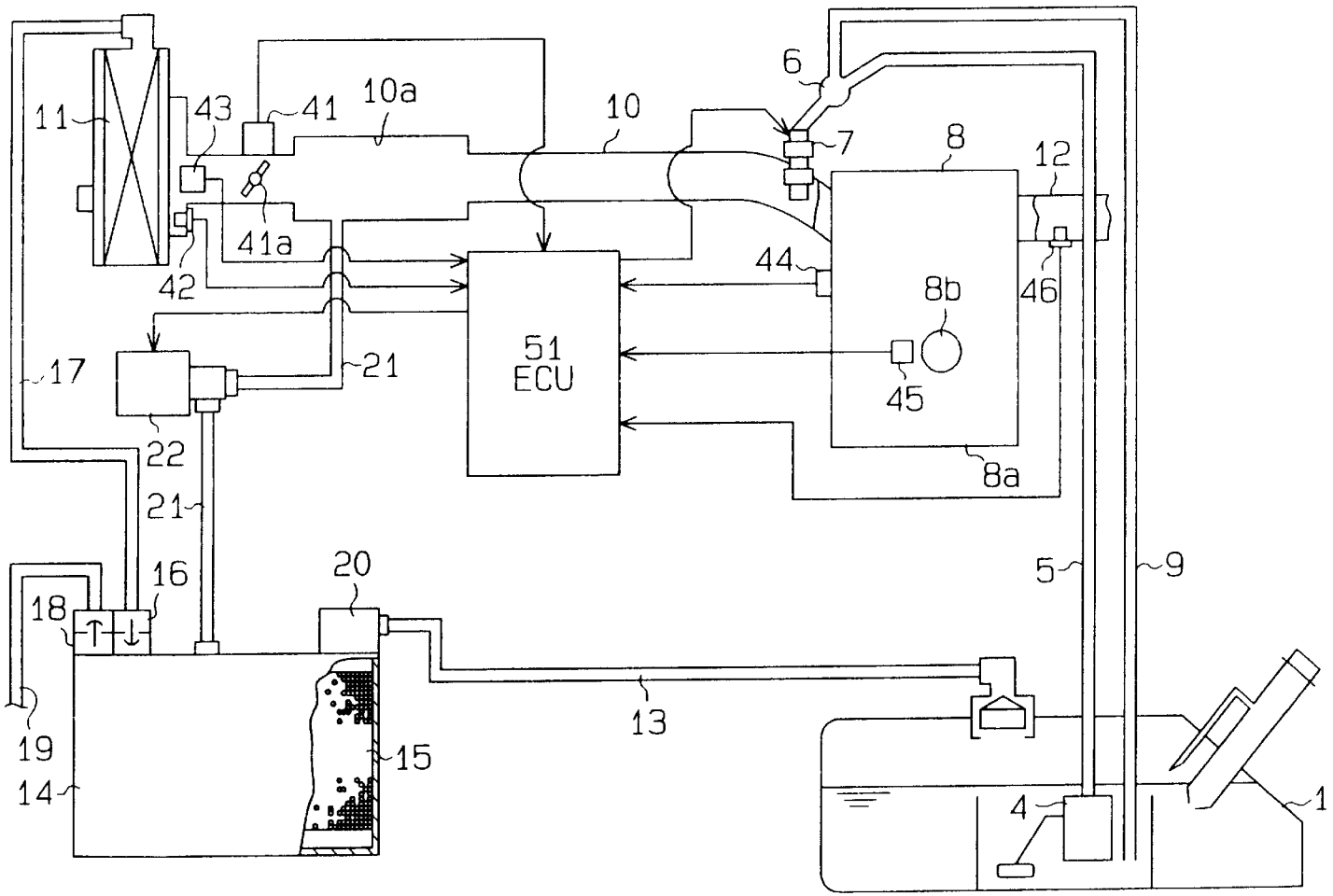
FIG. 1 is a diagrammatic view showing an air-fuel ratio control apparatus according to a first embodiment of the present invention.

An air-fuel ratio control apparatus according to a first embodiment of the present invention will now be described with reference to the drawings. As shown in FIG. 1, a gasoline engine 8, which is mounted on an automobile, is connected to an intake passage 10 and an exhaust passage 12. An air cleaner 11 is arranged at the distal end of the intake passage 10 to filter impurities from the air drawn into the intake passage 10. A throttle valve 41*a* located downstream of the air cleaner 11 pivots to adjust the flow of the intake air in the intake passage 10. The angle of the throttle valve 41*a*, or opening degree, is adjusted directly in accordance with the depression amount of a gas pedal (not shown) or indirectly through electronic control. The intake air is sent to the engine 8 by way of a surge tank 10*a*.

An injector 7 is provided for each engine cylinder in the intake passage 10 near the engine 8. Fuel is stored in a fuel tank 1. The fuel is pressurized by a pump 4 and sent into a main line 5. The pressurized fuel is then sent into a delivery pipe 6 and distributed to each injector 7. Each injector 7, which is controlled by an electronic control unit (ECU) 51, injects fuel into the intake passage 10. The injected fuel is mixed with the intake air flowing through the intake passage 10. The air-fuel mixture is then sent to each engine cylinder and combusted. The exhaust gas produced by the combustion is discharged externally through the exhaust passage 12. The residual fuel in the delivery pipe 6, which was not distributed to any one of the injectors 7, is returned to the fuel tank 1 through a return line 9.

The air-fuel ratio control apparatus of the first embodiment includes a fuel vapor processing device. The fuel vapor processing device collects the fuel vapor in the fuel tank 1 and prevents the fuel vapor from being released into the atmosphere. The collected fuel vapor is sent to the engine 1 for combustion and is thus not wasted. The fuel vapor in the fuel tank 1 is drawn into a canister 14 through a vapor line 13. The vapor line 13 includes a vapor control valve 20 to control the flow of fuel vapor. The vapor control valve 20 controls the flow of fuel vapor into the canister 14 in accordance with the difference between the pressure in the vapor line 13 and the fuel tank 1 and the pressure in the canister 14. The canister 14 contains an adsorbent 15, such as activated carbon, to collect the fuel vapor.

In addition to the vapor line 13, the canister 14 is connected to an air pipe 17, an outlet pipe 19, and a purge line 21. The air pipe 17 is connected to the air cleaner 11. Some of the intake air is drawn into the canister 14 through the air pipe 17. The air pipe 17 includes a check valve, or first atmospheric valve 16. The first atmospheric valve 16 permits the flow of intake air into the canister 14 when the pressure in the canister 14 is lower than the atmospheric pressure.

The gases in the canister 14 are discharged externally through the outlet pipe 19. The outlet pipe 19 includes a check valve, or second atmospheric valve 18. The second atmospheric valve 18 opens and permits the discharge of the gases in the canister 14 when the pressure in the canister 14 is higher than the atmospheric pressure by a predetermined value or more. The first and second atmospheric valves 16, 18 maintain the pressure of the canister 14 at a value substantially equal to the atmospheric pressure.

The purge line 21 connects the canister 14 to the surge tank 10*a*. The fuel vapor collected in the canister 14 by the adsorbent is drawn, or purged, into the intake passage 10 by the vacuum pressure of the intake air flowing through the surge tank 10*a*. The purge line 21 includes a purge control valve 22 to control the amount of the purged fuel vapor. The purge control valve 22 is an electromagnetic valve that is duty controlled by the ECU 51.

Various sensors are provided to detect the operating state of the engine 8. An intake air temperature sensor 42 and an airflow meter 43 are arranged between the air cleaner 11 and the throttle valve 41*a* in the intake passage 10. The intake air temperature sensor 42 detects the temperature of the intake air, while the airflow meter 43 detects the flow of the intake air. A throttle position sensor 41 is located in the proximity of the throttle valve 41*a* to detect the opening degree of the throttle valve 41*a*. The sensors 41, 42, 42 send signals to the ECU 51. The ECU 51 computes an intake air volume Q based on the signal output by the airflow meter 43, an intake air temperature THA based on the signal output by the intake air temperature sensor 42, and a throttle opening degree TA based on the signal output by the throttle position sensor 41.

A coolant temperature sensor 44 and a crankshaft position sensor 45 are attached to the engine 8. The coolant temperature sensor 44 detects the engine coolant temperature, while the crankshaft position sensor 45 detects the rotational phase of the crankshaft 8*b*. The ECU 51 computes a coolant temperature THW based on the signal output by the coolant temperature sensor 44 and an engine speed NE based on the signal output by the crankshaft position sensor 45.

An oxygen sensor 46 is arranged in the exhaust passage 12 to detect the oxygen concentration of the exhaust gas. The ECU 51 computes the air-fuel ratio of the air-fuel mixture drawn into the engine 8 based on the signal output by the oxygen sensor 46.

Figure 2:
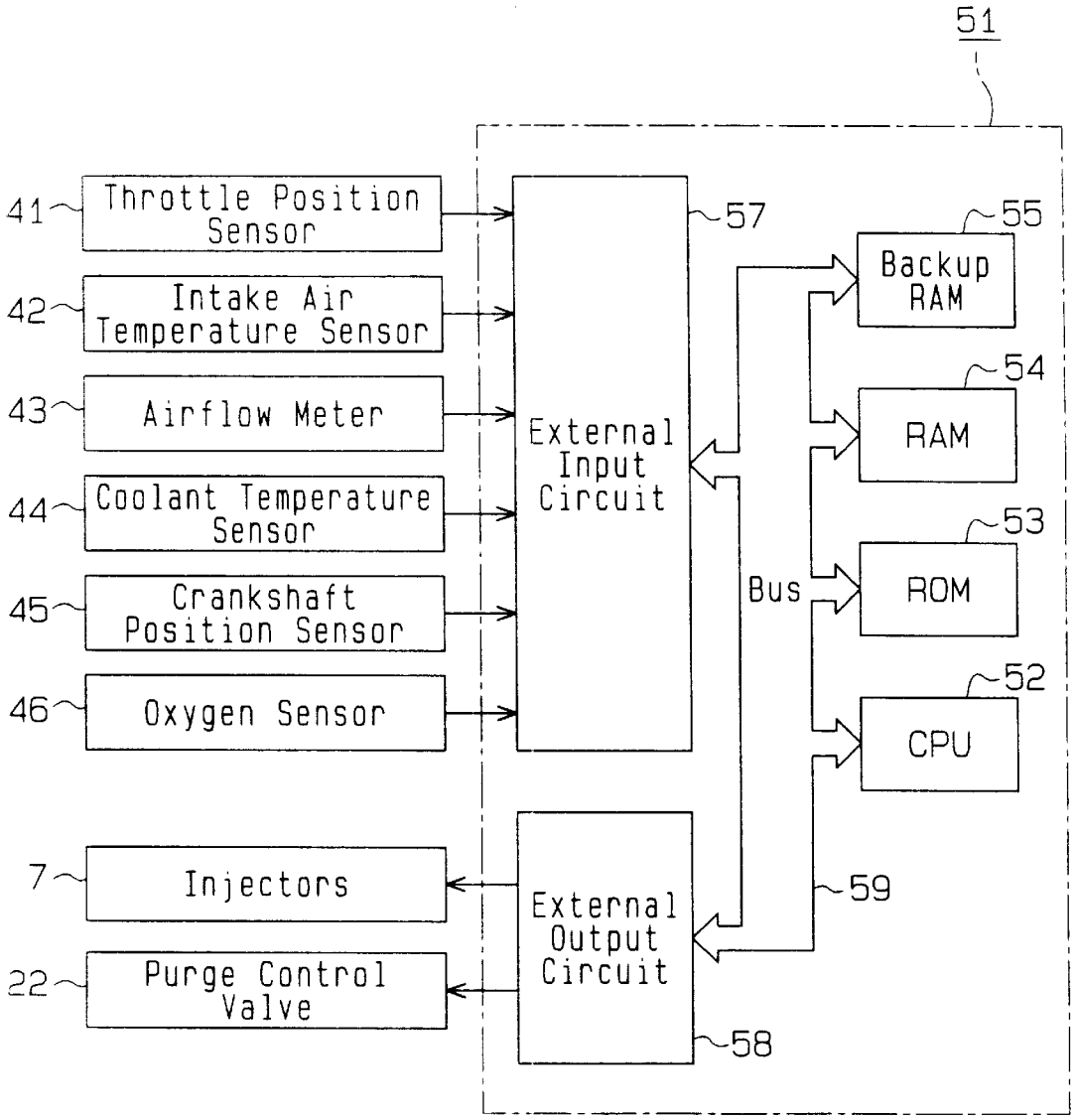
FIG. 2 is a block diagram showing the controller of FIG.

As shown in FIG. 2, the ECU 51 includes a central processing unit (CPU) 52, a read only memory (ROM) 53, a random access memory (RAM) 54, a backup RAM 55, an external input circuit 57, and an external output circuit 58. These devices 52, 53, 54, 55, 57, 58 are connected to one another by a bus 59.

Predetermined programs such as those related to air-fuel control and purge control are stored in the ROM 53. The CPU 52 executes computations based on the programs stored in the ROM 53. The computation results are temporarily stored in the RAM 54. The backup RAM 55 is a battery-backed nonvolatile memory that keeps the written data stored when the power of the ECU 51 is cut off.

The external input circuit 57 includes a buffer, a waveform shaping circuit, a filter, and an analog-to-digital (AD) converter. The signals output by the sensors 41, 42, 43, 44, 45, 46 are sent to the ECU 51 by way of the external input circuit 57. The external output circuit 58 includes drive circuits for driving the injectors 7 and the purge control valve 22. The command signals generated by the CPU 52 are sent to the injectors 7 and the purge control valve 22 by way of the external output circuit 58. The injectors 7 and the purge control valve 22 are driven in accordance with the command signals.

The ECU 51 computes the target air-fuel ratio in accordance with the operating state of the engine 8 and adjusts the amount of fuel injected from each injector 7 so that the air-fuel ratio matches the target value. Furthermore, the ECU 51 duty controls the opening degree of the purge control valve 22 in accordance with the operating state of the engine 8 to adjust the amount of purged fuel vapor. Changes in the amount of purged fuel vapor affect the air-fuel ratio of the air-fuel mixture. The changes must thus be taken into consideration when performing air-fuel ratio control.

The air-fuel ratio control and the purge control, which are executed by the CPU 52 will now be described. A map divided into a plurality of sections, each section corresponding with a different engine operating state, is stored in the RAM 54. Each map section includes parameters having variable values. When controlling the air-fuel ratio and the purging of fuel vapor, the parameter values of the map section corresponding to the operating state of the engine 8 are varied.

Figure 3:
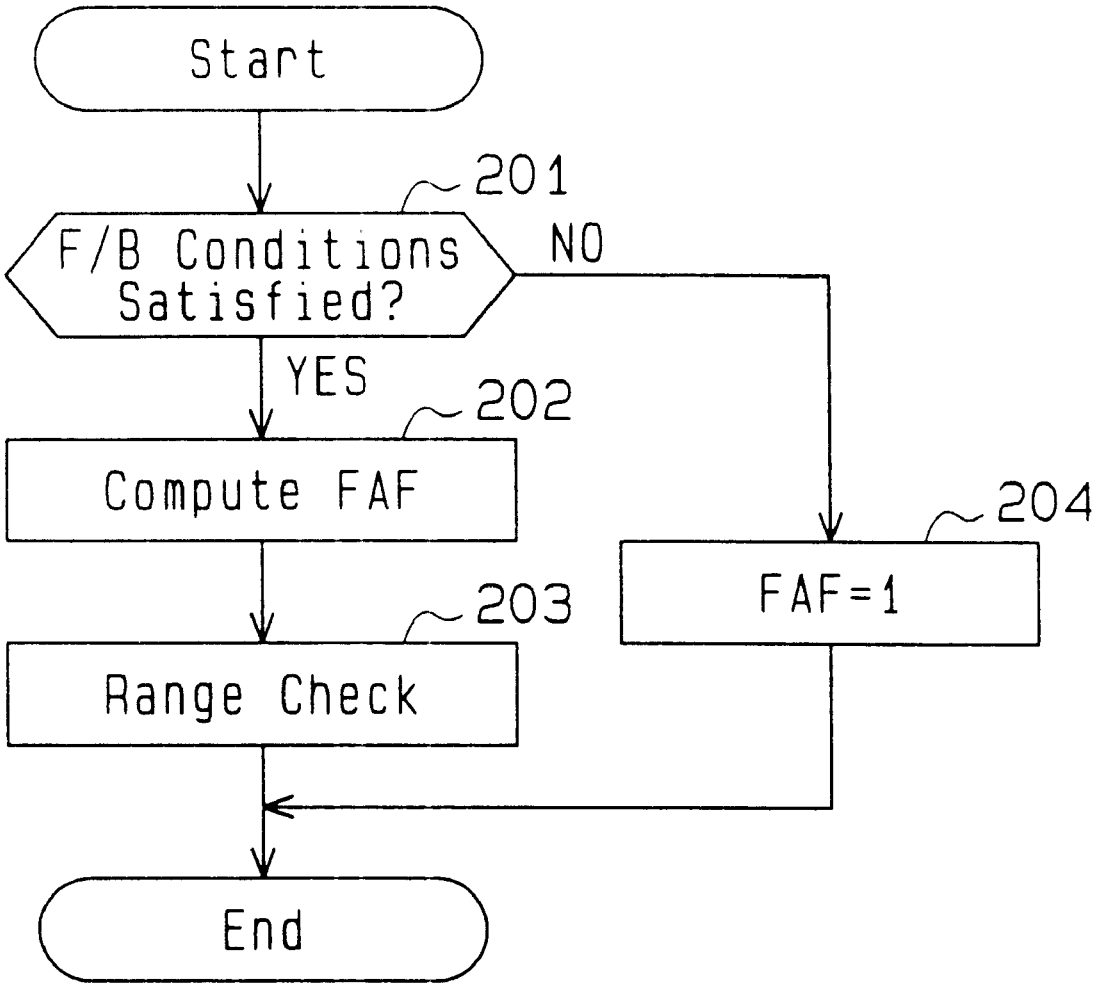
FIG. 3 is a flowchart showing a routine for controlling the air-fuel ratio feedback in the first embodiment.

FIG. 3 shows an air-fuel ratio feedback control routine. A feedback air-fuel ratio correction coefficient FAF is computed from the difference between the air-fuel ratio obtained during the previous combustion and the target air-fuel ratio. The routine is executed once every predetermined time period in an interrupting manner. In the first embodiment, the target air-fuel ratio is equal to the stoichiometric air-fuel ratio (14.7).

The CPU 52 first performs step 201 and determines whether the present operating state of the engine 8 satisfies conditions (a1) to (a5), which are as follows:

(a1) the engine 8 is not being cranked;

(a2) fuel injection has not been stopped;

(a3) the coolant temperature THW is equal to or higher than a predetermined value, that is, the engine 8 is warm;

(a4) the oxygen sensor 46 is active; and (a5) the engine 8 not in a high load, high speed state.

Each condition must be satisfied for the following reasons:

(a1, a3) since the fuel injection amount is increased to stabilize operation when the engine 8 is being cranked or is cold, the air-fuel mixture is unusually rich (the air-fuel ratio being lower than the stoichiometric ratio) at these times;

(a2) if fuel injection has not been shut off, the air-fuel ratio will be abnormal;

(a4) the air-fuel ratio cannot be detected unless the oxygen sensor is active; and (a5) the fuel injection amount is increased when the engine 8 is in a high load, high speed state to avoid an increase in the exhaust gas temperature.

If it is determined that any one of the conditions (a1) to (a5), or feedback control conditions (F/B conditions), is not satisfied in step 201, the CPU 52 proceeds to step 204. At step 204, the CPU 52 sets the feedback correction coefficient FAF to one. In this case, the air-fuel ratio feedback control is not executed.

If all the conditions (a1) to (a5) are satisfied in step 201, the CPU 52 proceeds to step 202. At step 202, the CPU 52 computes the present feedback correction coefficient FAF.

Figure 4A:
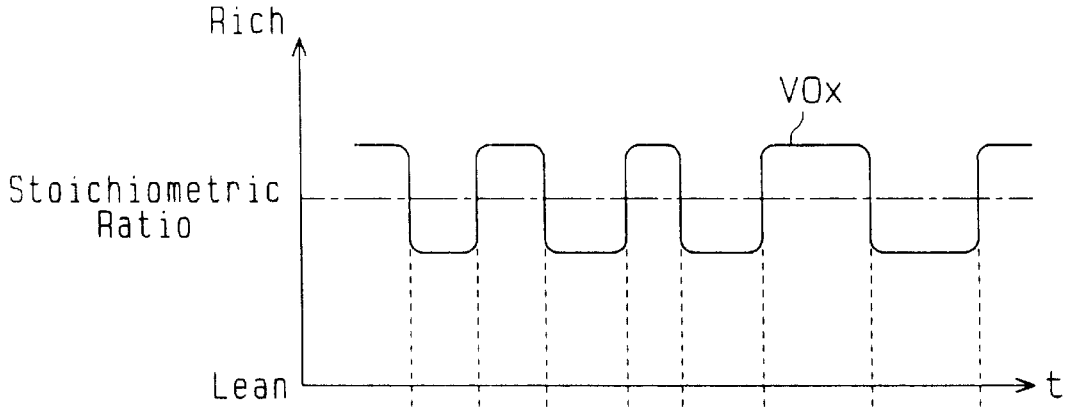
FIG. 4*a* is a time chart showing the behavior of an oxygen sensor signal.
Figure 4B:
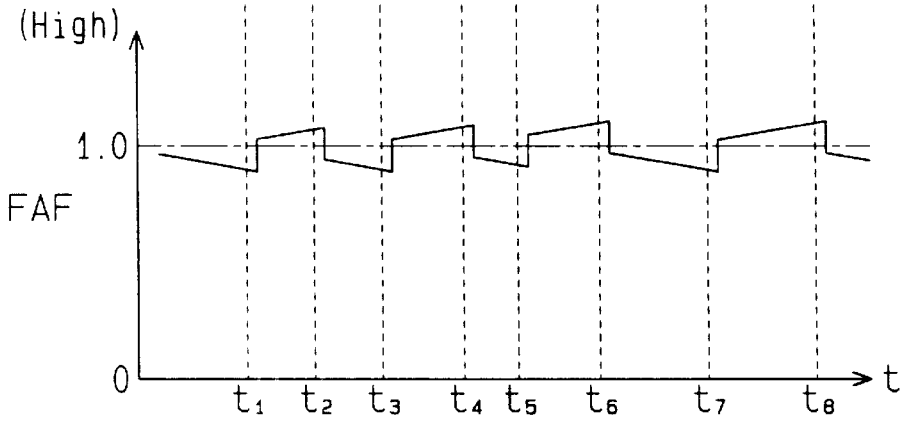
FIG. 4*b* is a time chart showing the shifting of a air-fuel ratio feedback correction coefficient.

The feedback correction coefficient FAF will now be described. FIG. 4*a* shows the behavior of a signal $VO_x$, which is output by the oxygen sensor 46. The voltage output by the oxygen sensor 46 changes in a sudden manner when the air-fuel ratio approaches the stoichiometric ratio. The CPU 52 uses this characteristic to determine whether the air-fuel mixture is rich (excessive fuel) or lean (excessive air). As shown in FIGS. 4*a* and 4*b*, the CPU 52 sets the feedback correction coefficient FAF at a value lower than one when the air-fuel ratio A/F is rich. If the rich state continues, the CPU 52 gradually decreases the value of the feedback correction coefficient FAF. For lean air-fuel ratios, the CPU 52 sets the feedback correction coefficient FAF at a value greater than one. If leanness continues, the CPU 52 gradually increases the value of the feedback correction coefficient FAF by a predetermined rate. As the signal from the oxygen sensor 46 changes from a state indicating a rich air-fuel ratio to a state indicating a lean air-fuel ratio, the CPU 52 shifts the correction coefficient FAF from a value lower than one to a value greater than one. On the other hand, when the signal from the oxygen sensor 46 changes from a state indicating a lean air-fuel ratio to a state indicating a rich air-fuel ratio, the CPU 52 shifts the correction coefficient FAF from a value greater than one to a value lower than one. This shifting of the feedback correction coefficient FAF improves response and control precision.

The computation of the feedback correction coefficient FAF is based on the previous feedback correction coefficient and the difference between the most recent air-fuel ratio A/F, which was detected by the oxygen sensor 46.

At step 203, the CPU 52 checks whether or not the value of the computed feedback correction coefficient FAF is within a predetermined range (range check). If the value of the computed feedback correction coefficient FAF is higher than the upper limit of the predetermined range, the feedback correction coefficient FAF is set at the uppermost value of the predetermined range. If the value of the computed feedback correction coefficient FAF is lower than the lower limit of the predetermined range, the feedback correction coefficient FAF is set at the lowermost value of the predetermined range. The CPU 52 then terminates the routine. The feedback correction coefficient FAF determined in this routine is used in subsequent routines including the purge control routine. The purge control routine will now be described.

Figure 5:
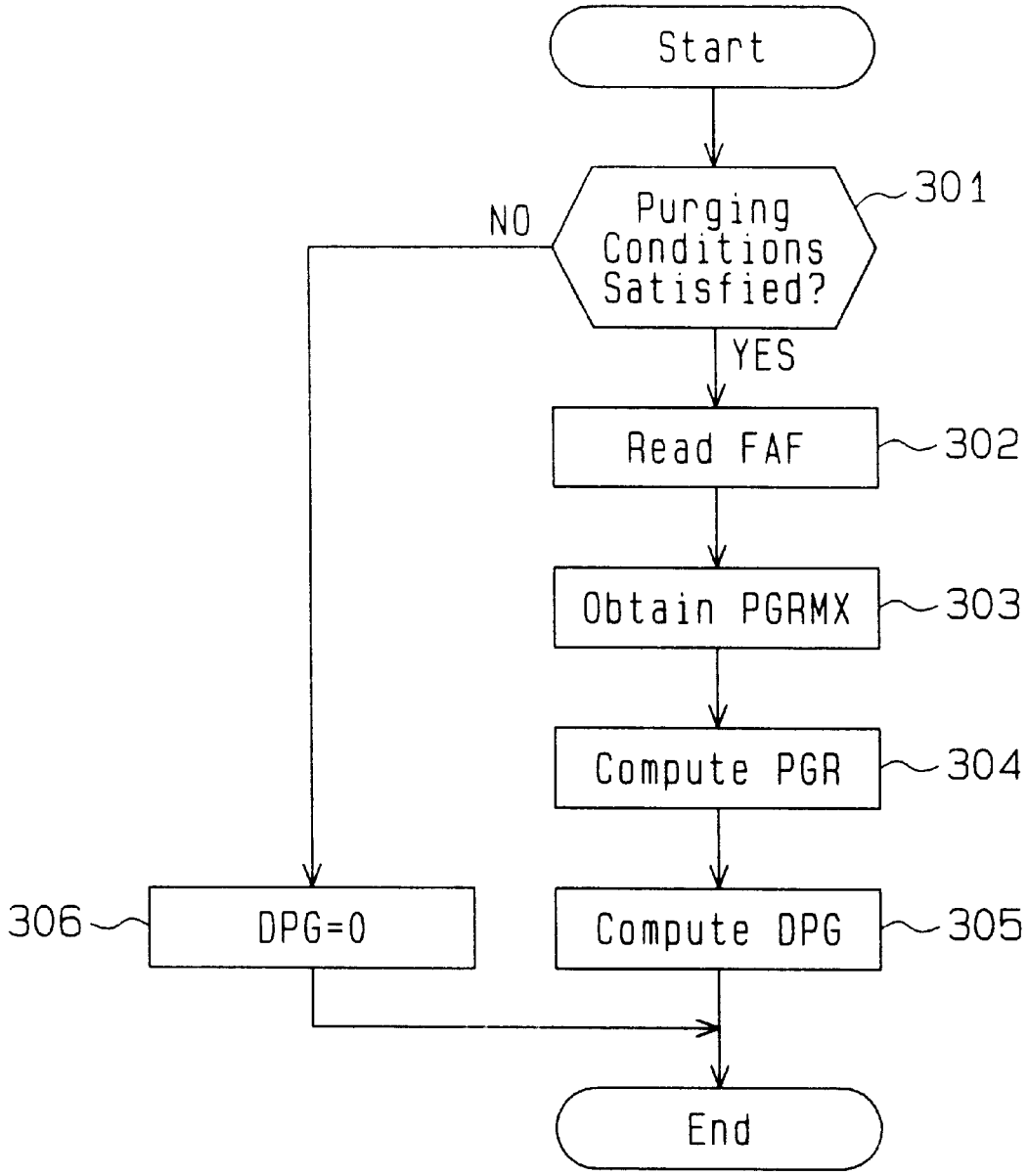
FIG. 5 is a flowchart showing a purge control routine of the first embodiment.

FIG. 5 shows the purge control routine for computing a control duty DPG, which determines the opening degree of the purge control valve 22. The routine is executed once every predetermined time period in an interrupting manner. The amount of fuel vapor purged into the intake air is adjusted in accordance with the operating state of the engine 8 through the purge control routine. In the first embodiment, the purge control valve 22 is completely closed when the control duty DPG is 0% and completely opened when the control duty DPG is 100%.

At step 301, the CPU 52 determines whether or not the conditions for purging fuel vapor into the intake passage 10 from the canister 14 are satisfied. The conditions are as follows:

(b1) fuel injection has not been shut off;

(b2) air-fuel ratio feedback control is being performed; and (b3) the learning of the air-fuel ratio has been completed.

If all conditions (b1) to (b3) are not satisfied, the CPU 52 proceeds to step 306 and sets the control duty DPG of the control valve 22 to 0%. This completely closes the purge control valve 22.

If every one of conditions (b1) to (b3) are satisfied, the CPU 52 proceeds to step 302. At step 302, the CPU 52 reads the air-fuel ratio feedback correction coefficient FAF, which has been computed in the air-fuel ratio feedback control routine of FIG. 3.

At step 303, the CPU 52 refers to a map to obtain a maximum purging rate PGRMX based on the present intake air flow rate Q and engine speed NE. The flow rate of the purged fuel vapor relative to the intake air flow rate Q is referred to as a purging rate. The maximum purging rate PGRMX indicates the flow rate of the purged fuel vapor relative to the intake air flow rate Q when the control duty DPG is 100%, or when the purge control valve 22 is completely opened.

At step 304, the CPU 52 computes a target purging rate PGR to purge fuel vapor at a rate that appropriately corresponds to the feedback correction coefficient read in step 302 and the present operating state of the engine 8. The target purging rate PGR is the target value of the purging rate of fuel vapor relative to the intake air flow rate Q.

At step 305, the CPU 52 computes the control duty DPG required to achieve the target purging rate PGR, which is based on equation (I).

$$DPG[\%]=(PGR/PGRMX)\times 100 \quad (I)$$

The opening degree of the purge control valve 22 is controlled by the control duty DPG, which has been computed in accordance with the operating state of the engine 8. After computation of the control duty DPG, the CPU 52 terminates the routine.

Figure 6:
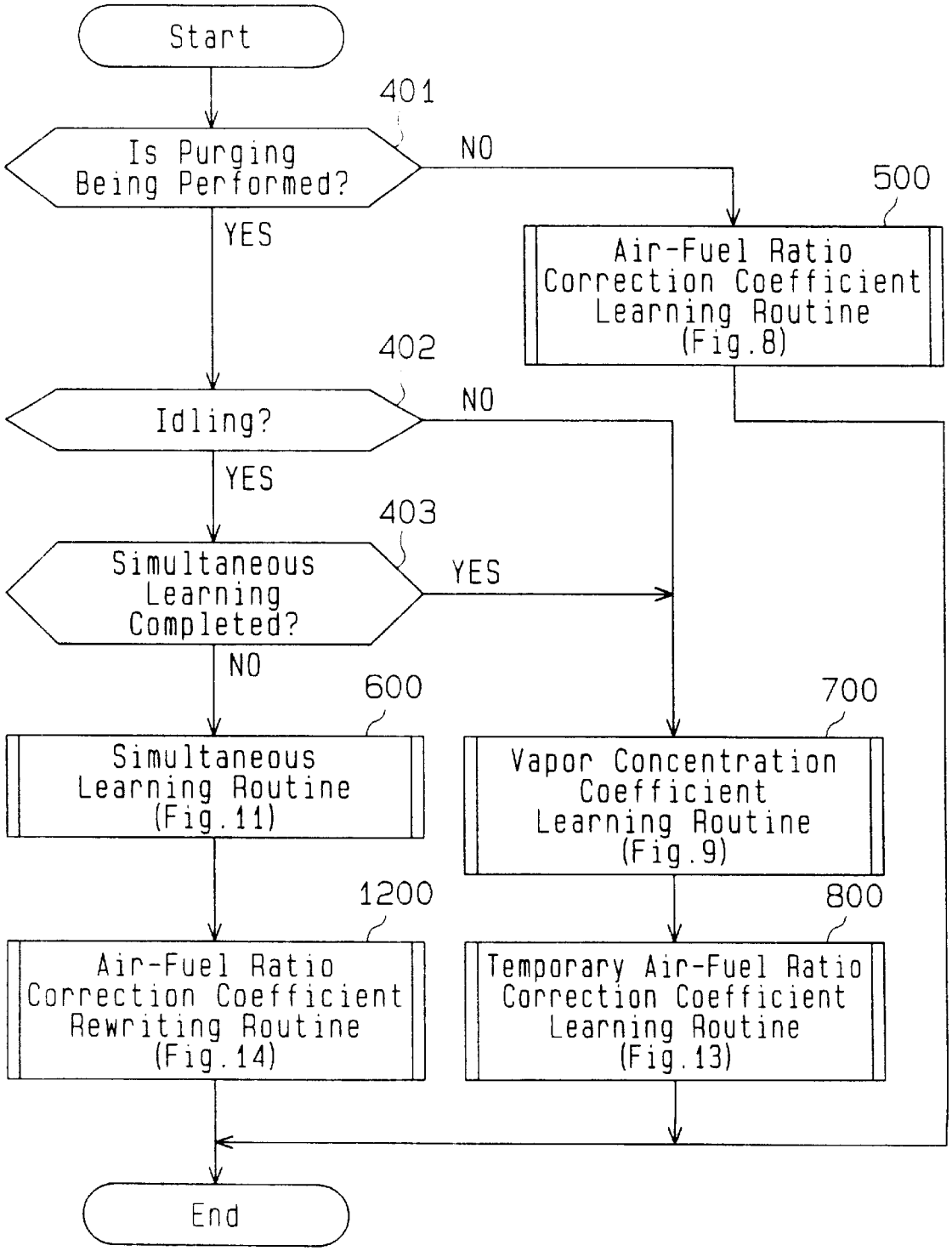
FIG. 6 is a flowchart showing a learning control routine of the first embodiment.

FIG. 6 shows a learning control routine, which is executed to learn the data necessary for appropriate air-fuel control. The routine is executed once every predetermined time period in an interrupting manner.

An air-fuel ratio correction coefficient KG is used to correct the difference between the air-fuel ratio obtained when fuel is injected for a basic fuel injection time TAUb and the stochiometric air-fuel ratio. The air-fuel ratio correction coefficient KG is set such that the feedback correction coefficient FAF is centered about the value of one. The air-fuel ratio correction coefficient KG compensates for deviations caused by wear and dimensional tolerances of the engine intake air system and the injectors 7. This improves the accuracy and response of the air-fuel ratio control.

A vapor concentration coefficient FGPG indicates the concentration of fuel in the purged fuel vapor. The influence that the purged fuel vapor has on the air-fuel ratio is determined by the concentration of fuel in the purged fuel vapor. The purging rate is obtained from the opening degree of the purge control valve 22. However, the concentration of fuel in the vapor cannot be obtained in such a direct manner. Thus, in the first embodiment, the concentration of fuel in the fuel vapor is indirectly obtained by using the vapor concentration coefficient FGPG. The concentration coefficient FGPG is a presumed value. Thus, the concentration coefficient FGPG must be renewed periodically to make sure that it reflects the actual fuel concentration in the purged fuel vapor.

When entering the routine, at step 401, the CPU 52 judges whether purging of the fuel vapor is being performed. If it is determined that purging is not being performed, the CPU 52 proceeds to step 500 and executes an air-fuel ratio learning routine to renew the air-fuel ratio correction coefficient KG. The purging of fuel vapor changes the air-fuel ratio. Therefore, the learning of the air-fuel ratio correction coefficient KG is carried out when purging is not occurring to obtain a correction coefficient KG that is unaffected by the purging. The air-fuel ratio correction coefficient learning routine will be described later with reference to FIG. 8.

If it is determined that purging is being performed in step 401, the CPU 52 proceeds to step 402. At step 402, the CPU 52 judges whether or not the engine 8 is idling (the vehicle speed is zero). If it is determined that the engine 8 is not idling, the CPU 52 proceeds to step 700 to execute a vapor concentration coefficient learning routine. If it is determined that the engine 8 is idling, the CPU 52 proceeds to step 403.

Figure 9:
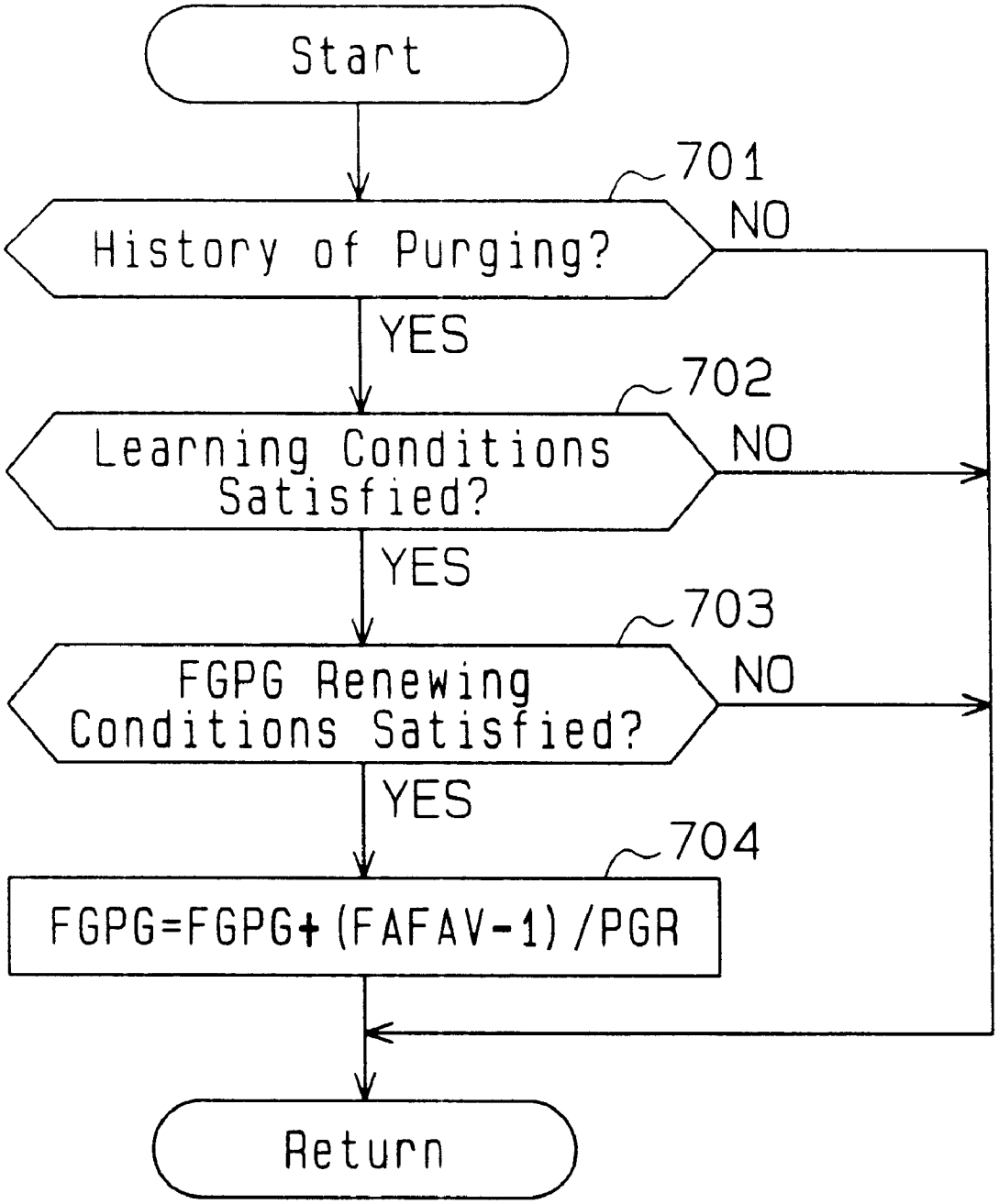
FIG. 9 is a flowchart showing a vapor concentration learning routine of the first embodiment.
Figure 13:
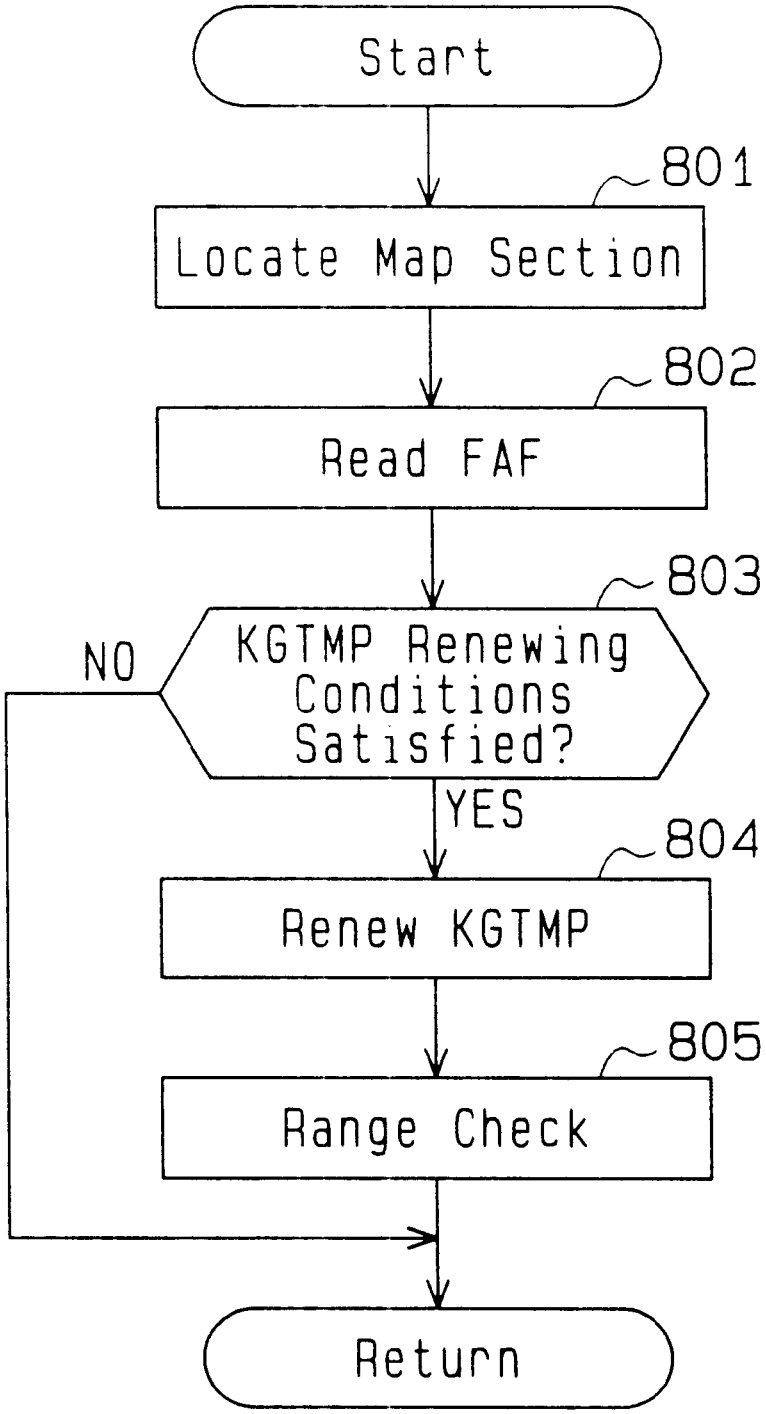
FIG. 13 is a flowchart showing a temporary air-fuel ratio learning routine of the first embodiment.

At step 403, the CPU 52 judges whether or not a simultaneous learning routine has been completed after entering the present idling state. If the simultaneous learning routine has been executed, the CPU 52 carries out steps 700 and 800. At step 700, the CPU 52 executes the vapor concentration learning routine, which is shown in FIG. 9, to renew the air-fuel ratio correction coefficient KG. At step 800, the CPU 52 executes a temporary air-fuel correction coefficient learning routine, which is shown in FIG. 13. A temporary air-fuel ratio correction coefficient KGTMP, which is learned in the temporary air-fuel ratio correction coefficient learning routine, is not immediately used but is used later to control the air-fuel ratio after being renewed to a formal air-fuel ratio correction coefficient when predetermined conditions, which will be described later, are satisfied. The vapor concentration coefficient learning routine and the temporary air-fuel ratio correction coefficient learning routine will be described later. After renewing the vapor concentration coefficient FGPG and the temporary air-fuel ratio correction coefficient KGTMP, the CPU 52 terminates the learning control routine.

Figure 11:
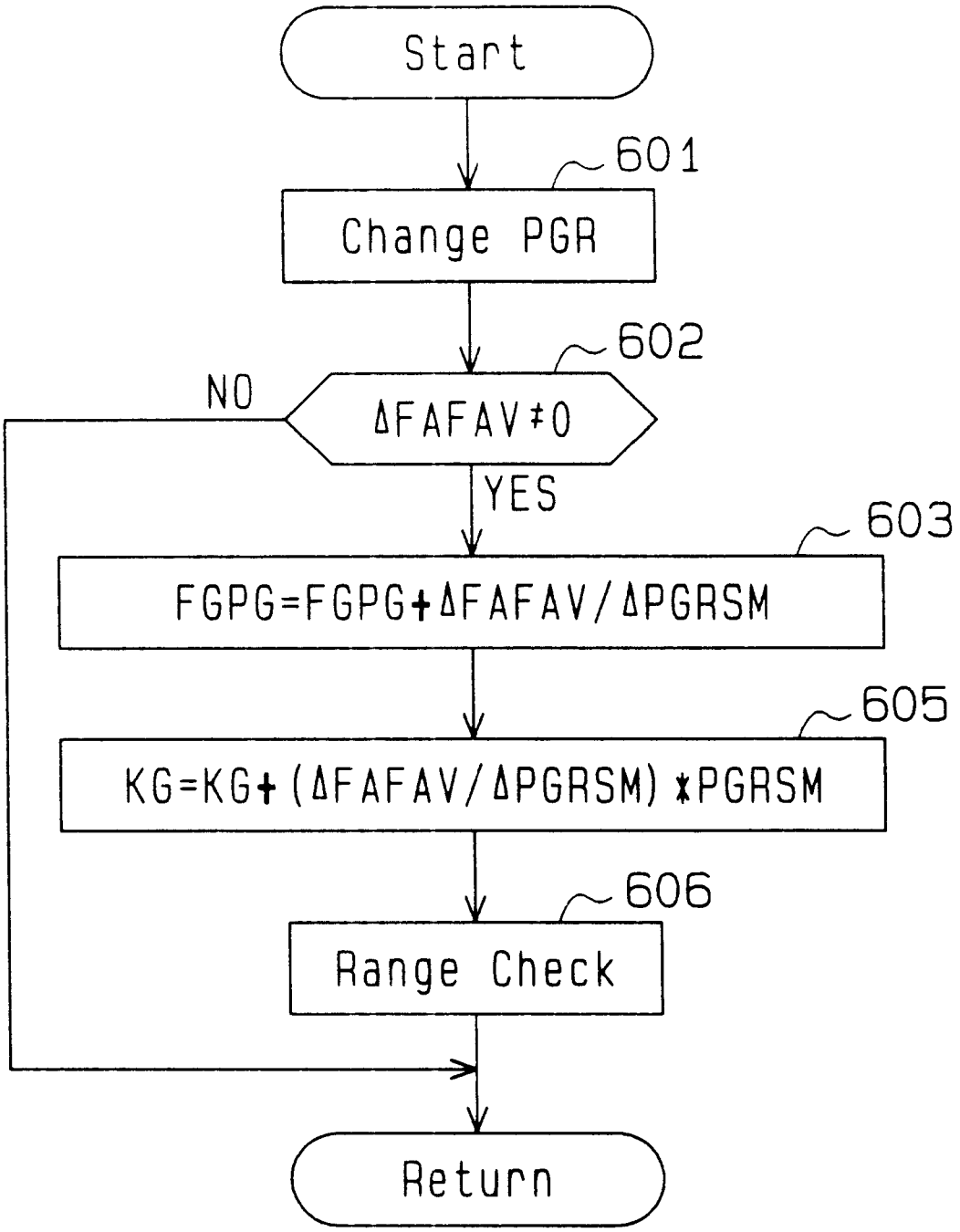
FIG. 11 is a flowchart showing a simultaneous learning control routine of the first embodiment.

If it is determined in step 403 that the simultaneous learning routine has not yet been executed after entering the current idling state, the CPU 52 proceeds to step 600 and executes the simultaneous learning routine, which is shown in FIG. 11. In the simultaneous learning routine, errors in the air-fuel ratio correction coefficient KG and the vapor concentration coefficient FGPG caused by changes in the flow rate of purged fuel vapor are computed in accordance with the change in the air-fuel ratio feedback correction coefficient FAF. The errors are corrected in renewing the coefficients KG, FGPG.

Figure 14:
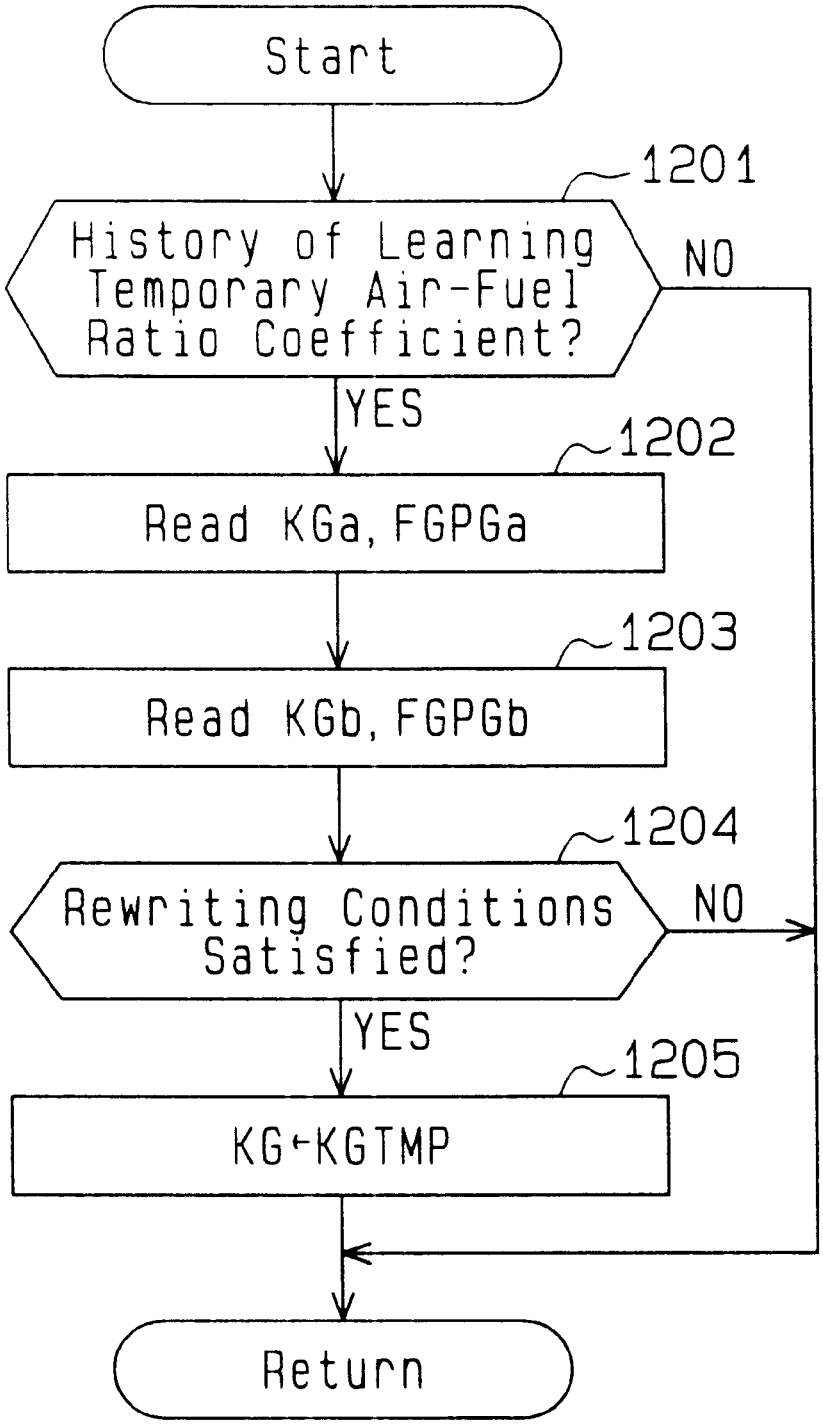
FIG. 14 is a flowchart showing an air-fuel ratio correction coefficient rewriting routine of the first embodiment.

After execution of the simultaneous learning routine is completed, the CPU 52 proceeds to step 1200 and executes an air-fuel ratio correction coefficient rewriting routine, which is shown in FIG. 14. The CPU 52 then terminates the learning control routine upon completion of the air-fuel ratio correction coefficient rewriting routine. In the coefficient rewriting routine, the CPU 52 judges whether or not to renew the formal air-fuel ratio correction coefficient KG to the temporary air-fuel correction coefficient KGTMP, which was obtained in the previous temporary air-fuel ratio correction coefficient learning routine. If predetermined conditions are satisfied, the air-fuel ratio correction coefficient KG is renewed and reflected in the air-fuel ratio control.

Figure 7:
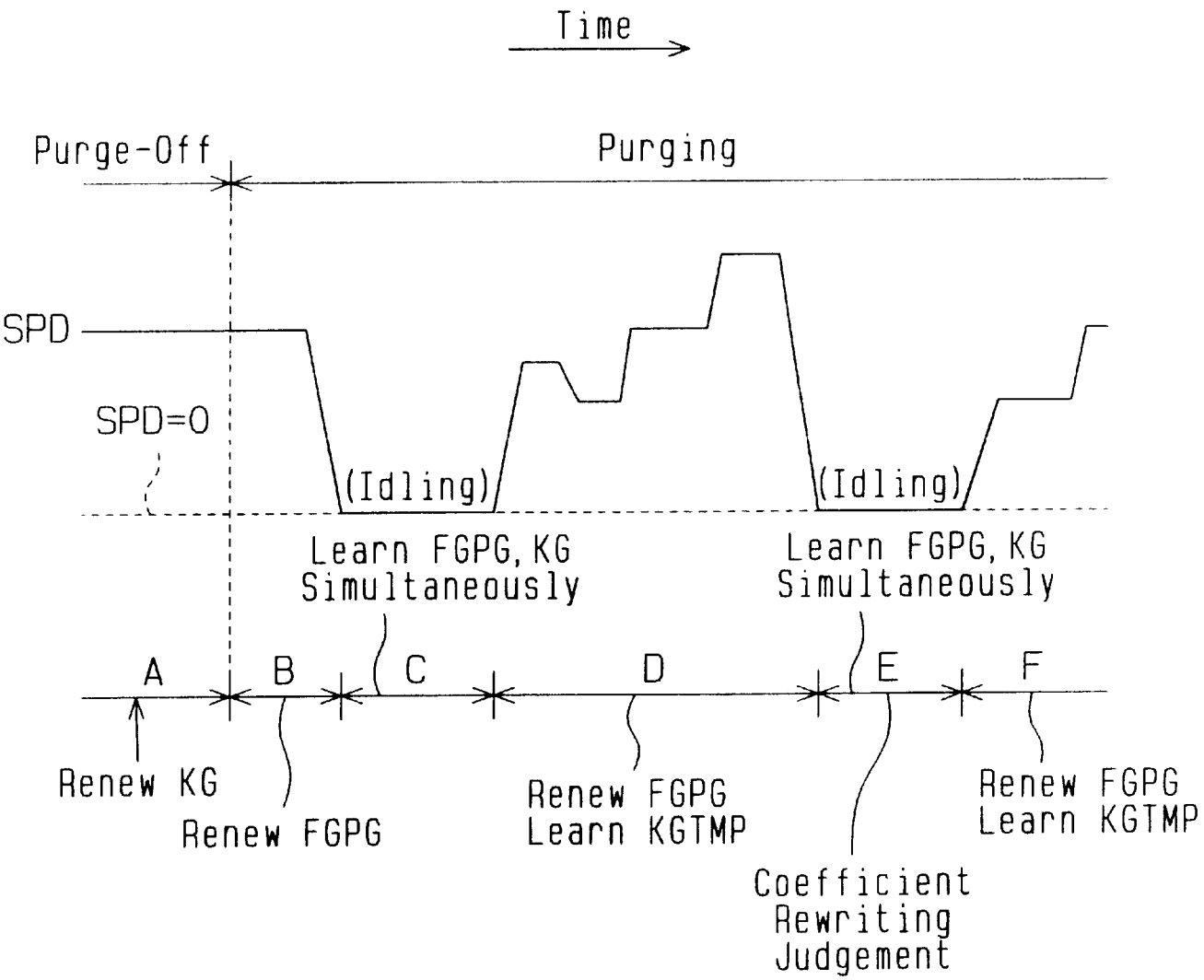
FIG. 7 is a time chart showing the relationship between the vehicle speed and the executed learning control.

FIG. 7 shows when the learning routines of the air-fuel ratio control are executed with respect to the vehicle speed SPD. In the first embodiment, the air-fuel ratio control apparatus renews the coefficients through different patterns in accordance with the operating state of the engine 8. Each pattern will now be described with reference to FIG. 7.

(i) During period A, the engine 8 is not purging fuel vapor. In this state, the air-fuel ratio correction coefficient learning routine is executed to renew the air-fuel ratio correction coefficient KG regardless of the vehicle speed SPD.

(ii) During periods B, D, and F, purging is being performed and the engine 8 is not idling. In this state, the vapor concentration coefficient learning routine is executed to renew the vapor concentration coefficient FGPG, and the temporary air-fuel ratio learning routine is executed to learn the temporary air-fuel ratio concentration coefficient KGTMP.

(iii) During periods C and E, purging is being performed and the engine 8 is idling. In this state, the simultaneous learning routine is executed to simultaneously renew the air-fuel ratio correction coefficient KG and the vapor concentration coefficient FGPG. During period E, the air-fuel ratio correction coefficient rewriting routine is also executed to compare the present vapor concentration coefficient FGPG with the previous vapor concentration coefficient FGPG, which was obtained in the preceding idling state (period C), and to judge whether or not to register the temporary air-fuel ratio correction coefficient KGTMP, which was obtained in the temporary air-fuel ratio correction coefficient learning routine, as the formal correction coefficient KG.

Figure 8:
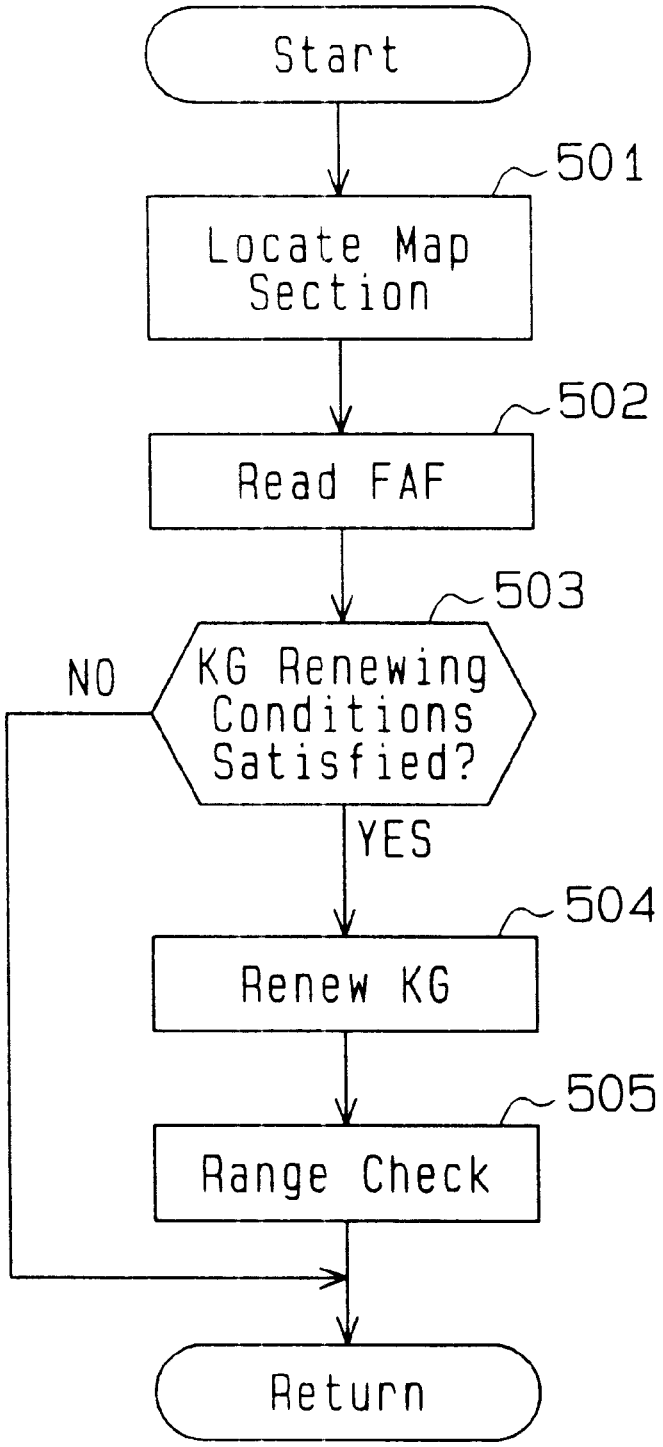
FIG. 8 is a flowchart showing an air-fuel ratio correction coefficient learning routine of the first embodiment.

FIG. 8 shows the air-fuel ratio correction coefficient learning routine, which is executed when the engine 8 is not purging fuel. The air-fuel ratio correction coefficient KG is stored in a map. The map has a plurality of sections, and each section corresponds to a different engine operating state. The appropriate section is determined in accordance with the intake air flow rate Q and other conditions. An air-fuel ratio correction coefficient KG is stored in each map section. Thus, every map section stores an air-fuel ratio correction coefficient KG that corresponds to the operating state of the engine 8.

At step 501, the CPU 52 locates the section of the map corresponding to the present operating state of the engine 8. At step 502, the CPU 52 reads the air-fuel ratio feedback correction coefficient FA, which has been computed in the air-fuel ratio feedback control routine. At step 503, the CPU 52 judges whether the renewing conditions of the air-fuel ratio correction coefficient KG are satisfied. The conditions are as follows:

(c1) the air-fuel ratio feedback control routine is being executed;

(c2) the fuel injection amount is no longer being increased for cranking of the engine 8 and the engine 8 is not being cranked;

(c3) the fuel injection amount is no longer being increased to warm the engine 8, and the engine 8 is not being cranked;

(c4) the coolant temperature THW is equal to or higher than a predetermined temperature;

(c5) the renewal of the air-fuel ratio correction coefficient KG in the corresponding map section is not yet completed after cranking the engine 8;

(c6) the shifting of the feedback correction coefficient FAF in the present map section having occurred consecutively for more than a predetermined number of times; and (c7) the average FAFAV of the feedback correction coefficient FAF has deviated from 1.00 by more than a predetermined value, for example, in the first embodiment, by 0.02.

If it is determined that any one of conditions (c1) to (c7) is not satisfied in step 503, the CPU 52 terminates the routine and does not renew the air-fuel ratio correction coefficient KG of the map section corresponding to the present operating state of the engine 8.

If it determined that all of conditions (c1) to (c7) are satisfied in step 503, the CPU 52 proceeds to step 504 and renews the air-fuel ratio correction coefficient KG. The renewal of the air-fuel ratio correction coefficient KG in the map section corresponding to the present operating state of the engine 8 is carried out as described below.

The CPU 52 determines whether the feedback correction coefficient average FAFAV is 1.02 or more or 0.98 or less. If the average FAFAV is 1.02 or more, the CPU 52 adds a predetermined value (grading value) a to the stored air-fuel ratio correction coefficient KG to obtain a new correction coefficient KG. If the average FAFAV is 0.98 or less, the CPU 52 subtracts the predetermined value a from the stored air-fuel ratio correction coefficient KG to obtain a new correction coefficient KG.

As in step 203 of the flowchart shown in FIG. 3, at step 505, the CPU 52 checks whether the new air-fuel ratio correction coefficient KG is within a predetermined range. If the correction coefficient KG is within the predetermined range, the correction coefficient KG is stored in the corresponding map section. When the new learned value KG is higher than the upper limit of the predetermined range, the learned value KG is stored as the uppermost value of the predetermined range. When the new correction coefficient KG is lower than the lower limit of the predetermined range, the learned value KG is stored as the lowermost value of the predetermined range. Afterward, the routine is terminated.

FIG. 9 is a flowchart showing the vapor concentration coefficient learning routine. The vapor concentration coefficient learning routine is executed when purging is performed and the simultaneous learning routine is not executed.

When entering the vapor concentration coefficient learning routine, at step 701, the CPU 52 determines whether there is a history of purging fuel vapor after the most recent cranking of the engine 8. If there is no history of purging, the routine is terminated.

If it is determined that there is a history of purging in step 701, the CPU 52 proceeds to step 702 and determines whether or not the vapor concentration coefficient learning conditions are satisfied. The conditions are as follows:

(d1) the air-fuel ratio correction coefficient KG is not undergoing renewal;

(d2) the coolant temperature THW is equal to or greater that a predetermined value;

(d3) the battery voltage is equal to or greater than a predetermined value; and (d4) the median of the feedback correction coefficient FAF has deviated from 1.00 by less than a predetermined value.

At step 703, the CPU 52 judges whether or not the renewing conditions of the vapor concentration coefficient FGPG are satisfied. The conditions are as follows:

(e1) the engine 8 is not being cranked;

(e2) fuel injection has not been shut off;

(e3) the coolant temperature THW is equal to or greater that a predetermined value (i.e., the engine 8 is warm);

(e4) the oxygen sensor 46 is activated;

(e5) the engine 8 is not in a high load, high speed state;

(e6) the most recent value of the target purging rate PGR is within a predetermined range; and (e7) the detecting signals from the sensors are normal.

If it is determined that the learning conditions are not satisfied in step 702 or that the renewing conditions are not satisfied in step 703, the CPU 52 terminates the routine.

If it is determined that the learning conditions and the renewing conditions are both satisfied (steps 702 and 703), the CPU 52 proceeds to step 704 and renews the vapor concentration coefficient FGPG in accordance with the most recent values of the feedback correction coefficient FAF and the target purging rate PGR. The CPU 52 computes and renews the vapor concentration coefficient FGPG from equation (II).

$$[\text{renewed FGPG}]=[\text{previous FGPG}]+(\text{FAFAV}-1)/\text{PGR} \quad \text{(II)}$$

Figure 10:
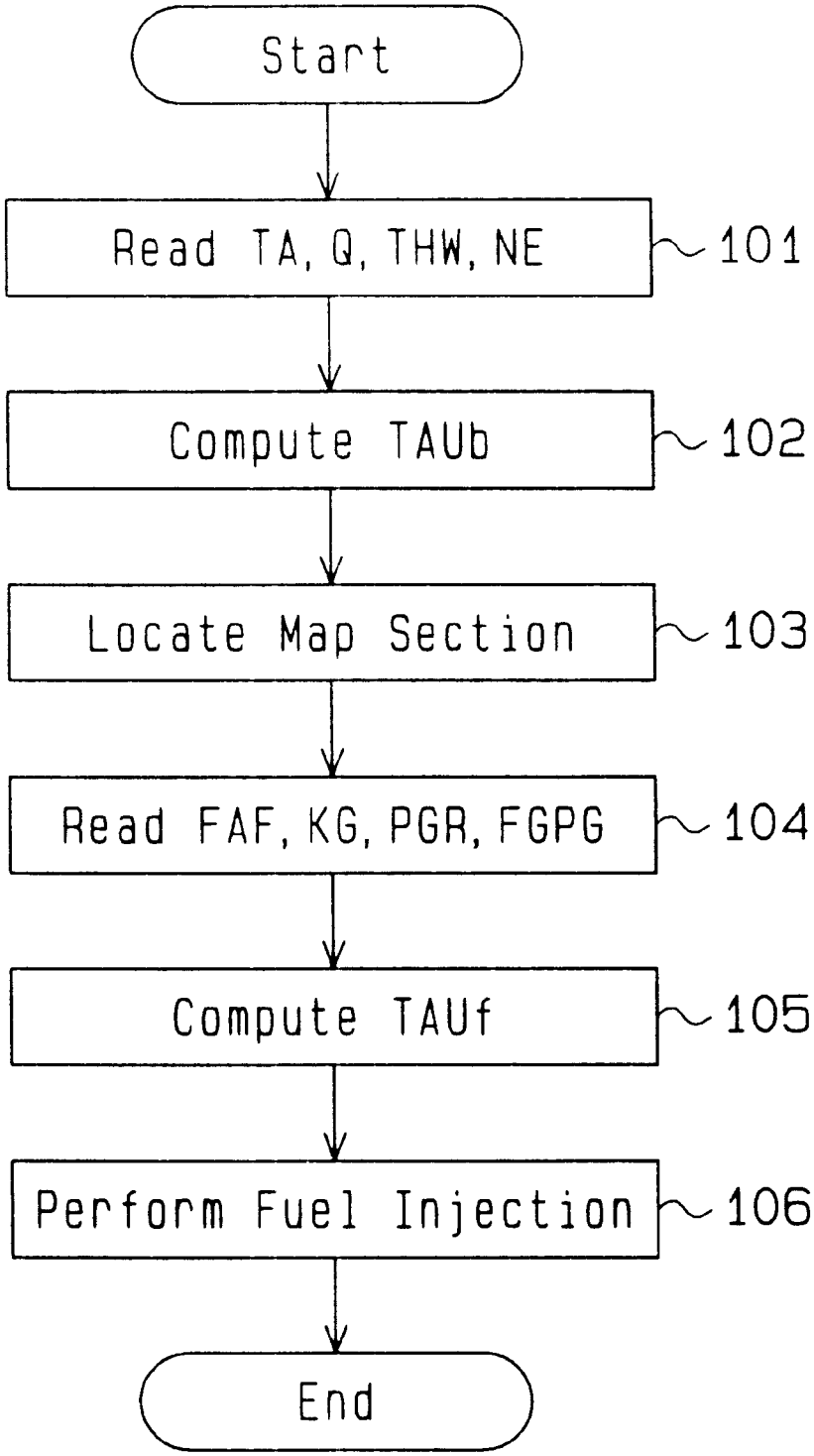
FIG. 10 is a flowchart showing a fuel injection control routine of the first embodiment.

FIG. 10 is a flowchart showing a fuel injection control routine, which is executed to determine the amount of fuel injected from each injector 7 in accordance with the obtained coefficient and learned values. The fuel injection control routine is executed in an interrupting manner for every predetermined crank angle that corresponds to the intake stroke of each engine cylinder.

At step 101, the CPU 52 reads the parameters related to the operating state of the engine 8, such as the throttle opening degree TA, the intake air flow rate Q, the coolant temperature THW, and the engine speed NE. The throttle opening degree TA is obtained from the detection results of the throttle sensor 41. The intake air flow rate Q is obtained from the detection results of the airflow meter 43. The engine speed NE is detected from the detection results of the crank angle sensor 45.

At step 102, the CPU 52 obtains a basic fuel injection time TAUb that corresponds to the parameters by referring to a known predetermined map (not shown).

At step 103, the CPU 52 locates the map section that corresponds to the operating state of the engine 8 based on the present intake air flow rate Q.

At step 104, the CPU 52 reads the feedback correction coefficient FAF, the air-fuel ratio correction coefficient KG of the map section corresponding to the present engine operating state, the target purging rate PGR, and the vapor concentration coefficient FGPG, which have been computed in the associated routines.

At step 105, the CPU 52 computes the final fuel injection time TAUf from equation (III).

$$\text{TAUf}=\text{TAUb}\times(\text{FAF}+\text{KG})\times\{1+\text{PGR}\times(\text{FGPG}-1)\}\times K1\times K2\times\ldots Kn \quad \text{(III)}$$

In the equation, K1 to Kn are coefficients corresponding to various parameters representing the operating state of the engine 8, such as the increased amount of fuel injection when warming the engine 8, acceleration and deceleration, and an increase in engine output. These parameters are computed through routines that are not described above. The most recent values of the coefficients K1 to Kn are temporarily stored in the RAM 54 and used to compute the final fuel injection time TAUf.

The clause $\{1+\text{PGR}\times(\text{FGPG}-1)\}$ in equation (III) represents the influence that the purged fuel vapor has on the air-fuel ratio. The influence that the fuel vapor has on the air-fuel ratio A/F can be corrected properly regardless of the target purging rate PGR as long as the vapor concentration coefficient FGPG is obtained properly in the vapor concentration learning routine.

After computing the final fuel injection time TAUf, the CPU 52 proceeds to step 106 and performs fuel injection in accordance with the final fuel injection time TAUf. The CPU then terminates the routine.

As described above, the air-fuel control apparatus of the first embodiment renews the air-fuel ratio correction coefficient KG when purging is not occurring and renews the vapor concentration coefficient FGPG during purging in order to execute air-fuel ratio control in a manner optimally corresponding to the operating state of the engine 8. Since the demand for reducing undesirable emissions has become stronger during recent years, the purging of the fuel vapor must be performed a greater number of times. However, an increase in the number of purges inevitably decreases the opportunities for renewing the air-fuel ratio correction coefficient KG. Thus, the air-fuel ratio correction coefficient KG may not correspond to the actual air-fuel ratio. This may decrease accuracy when controlling the air-fuel ratio.

Accordingly, during execution of the learning control routine illustrated in FIG. 6, the air-fuel ratio control apparatus of the first embodiment executes the simultaneous learning routine if the engine 8 is idling when purging is being performed. The apparatus also executes the temporary air-fuel ratio correction coefficient learning routine when purging is being performed. This compensates for the decreased renewing opportunities of the air-fuel ratio correction coefficient KG during purging and improves the accuracy of the air-fuel ratio control.

FIG. 11 is a flowchart showing the simultaneous learning routine executed when the engine 8 is idling while purging is being performed. During idling, the engine 8 is in a stable operating state and the air-fuel ratio is barely affected by external factors. In other words, the parameters related with the air-fuel ratio control fluctuate within a narrow range.

Figure 12A:
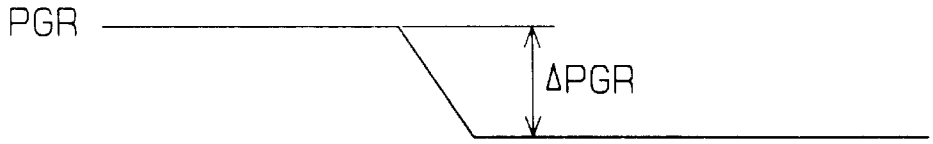
FIG. 12*a* is a time chart showing the shifting of the air-fuel ratio correction coefficient average value.
Figure 12B:
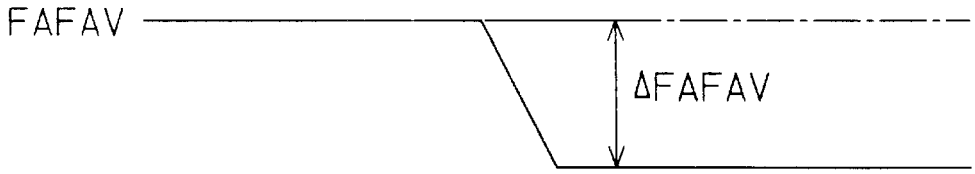
FIG. 12*b* is a time chart showing the shifting of the purge percentage.

At step 601, the CPU 52 temporarily and forcibly changes the target purging rate PGR regardless of the operating state of the engine 8. This alters the opening degree of the purged control valve 22 and the amount of purged fuel vapor. As long as the vapor concentration coefficient FGPG is a value properly corresponding to the actual state, the influence which the changed target purging rate PGR and purging rate has on the air-fuel ratio A/F is immediately corrected for. Accordingly, there should be no changes in the average FAFAV of the air-fuel ratio feedback correction coefficient FAF corresponding to the actual air-fuel ratio A/F. If the average FAFAV of the air-fuel ratio feedback correction coefficient FAF changes when the target purging rate PGR is changed, as shown in FIGS. 12*a* and 12*b*, this would indicate that the actual air-fuel ratio A/F has fluctuated even though changes in the amount of fuel vapor should immediately have been compensated for. In other words, this would indicate that the vapor concentration coefficient FGPG has been learned erroneously.

Therefore, in step 601 of FIG. 11, the CPU 52 changes the target purging rate PGR to change the purge fuel vapor amount and then proceeds to step 602. At step 602, the CPU 52 confirms the fluctuation of the average FAFAV of the feedback correction coefficient FAF to judge whether the air-fuel ratio A/F has fluctuated due to changes in the purged fuel vapor amount. If it is determined that the average FAFAV has not changed, the CPU 52 determines that coefficients FGPG and KG have been learned properly. In this case, the CPU 52 does not change the coefficients FGPG and KG and terminates the routine.

If it is determined that the average FAFAV has changed, the CPU 52 determines that the coefficients FGPG and KG have been learned erroneously. In this case, the CPU proceeds to step 603 and corrects the vapor concentration coefficient FGPG using equation (IV).

$$\text{(renewed) FGPG}=\text{(previous) FGPG}+\Delta\text{FAFAV}/\Delta\text{PGRSM} \quad \text{(IV)}$$

In this equation, ΔPGRSM represents the fluctuated amount of the grading value of the target purging rate before and after changes in the amount of the purged fuel vapor. The ratio ΔFAFAV/ΔPGRSM represents the influence that the change in the target purging rate PGR has on the feedback correction coefficient FAF and corresponds to the difference between erroneously learned vapor concentration coefficient FGPG and the correction vapor concentration (the dashed line in FIG. 12*b*).

At step 605, the CPU 52 corrects the air-fuel ratio correction coefficient KG using equation (V).

$$\text{(renewed) KG}=[\text{previous KG}]+(\Delta\text{FAFAV}/\Delta\text{PGRSM})\times\text{PGRSM} \quad \text{(V)}$$

In this equation, PGRSM represents the grading value of the target purging rate PGR after the amount of purged fuel vapor changes.

After renewing the coefficients FGPG and KG in steps 603 and 605, the CPU 52 proceeds to step 606. At step 606, the CPU 52 checks whether the renewed air-fuel ratio KG is within a predetermined range (range check) in the same manner as step 505 of the air-fuel ratio correction coefficient learning routine shown in FIG. 8. The renewed learned value KG is used if it is within the predetermined range. If the renewed learned value KG is not in the predetermined range, the learned value KG is corrected to the uppermost or lowermost value of the range. Therefore, the simultaneous learning routine allows the air-fuel ratio correction coefficient KG to be renewed even when purging is being performed.

Accordingly, the air-fuel ratio control apparatus of the first embodiment renews the vapor concentration coefficient FGPG through the vapor concentration learning routine and then learns a temporary air-fuel ratio correction coefficient KG. Furthermore, if certain conditions are satisfied, the temporary values are changed to formal values to increase the renewing opportunities of the air-fuel ratio correction coefficient KG.

It is preferred that the renewal of the coefficients be carried out in stable operating states, such as when the engine 8 is idling. The renewal of the learned values may also be performed when the engine 8 is in a transitional operating state. In such case, however, the learning accuracy would decrease by a certain degree since external factors would affect the computed coefficients.

FIG. 13 is a flowchart showing the temporary air-fuel ratio correction coefficient learning routine, which is executed when the fuel vapor is being purged. This routine is executed in a manner similar to the air-fuel ratio correction coefficient learning routine of FIG. 8. The temporary air-fuel ratio learning routine renews the temporary air-fuel ratio coefficient KGTMP instead of the air-fuel ratio correction coefficient KG.

At step 801, the CPU 52 locates the map section that corresponds to the present operating section of the engine 8.

At step 802, the CPU 52 reads the air-fuel ratio feedback correction coefficient FAF computed in the air-fuel ratio feedback control routine.

At step 803, the CPU 52 judges whether or not the renewing conditions of the temporary air-fuel ratio value KGTMP are satisfied. The renewing conditions are the same as the renewing conditions of the air-fuel ratio correction coefficient in the associated learning routine (refer to step 503 of FIG. 8). If it is determined that the renewing conditions are not satisfied, the CPU 52 does not renew the temporary air-fuel ratio coefficient KGTMP and thus terminates the routine. If it is determined that the renewing conditions are satisfied, the CPU 52 proceeds to step 804.

At step 804, the CPU 52 renews the temporary air-fuel ratio coefficient KGTMP. The renewal of the temporary air-fuel ratio coefficient KGTMP is carried out in the same manner as that of the air-fuel ratio correction coefficient KG.

At step 805, the CPU 52 checks whether or not the renewed temporary air-fuel ratio coefficient KGTMP is within a predetermined range.

The CPU 52 judges whether or not to use the temporary air-fuel ratio coefficient KGTMP as the formal air-fuel ratio correction coefficient KG during execution of the air-fuel ratio correction coefficient rewriting routine, which is executed after the simultaneous learning routine, when the engine 8 subsequently enters an idling state.

FIG. 14 is a flowchart showing the air-fuel ratio correction coefficient rewriting routine. At step 1201, the CPU 52 judges whether there is a history of execution of the temporary air-fuel ratio correction coefficient learning routine. If it is determined that there is no history, the CPU 52 terminates the routine. If it is determined that there is a history of learning the temporary air-fuel ratio coefficient after cranking of the engine 8, the CPU 52 proceeds to step 1202.

At step 1202, the CPU 52 reads an air-fuel ratio correction coefficient KGa and a vapor concentration coefficient FGPGa. The coefficients KGa, FGPGa are values that were obtained during the simultaneous learning routine executed during the previous idling state of the engine 8.

At step 1203, the CPU 52 reads an air-fuel ratio correction coefficient KGb and a vapor concentration coefficient FGPGb. The coefficients KGb, FGPGb are the values that were obtained during the simultaneous learning routine that was executed just before the present air-fuel ratio correction coefficient rewriting routine.

At step 1204, the CPU 52 judges whether or not the air-fuel ratio coefficient rewriting conditions for employing the temporary air-fuel ratio coefficient KGTMP as the formal air-fuel ratio coefficient are satisfied. The conditions are as follows:

(f1) the vapor concentration coefficients FGPGa, FGPGb are substantially equal to each other;

(f2) the fuel concentration of the fuel vapor, which is obtained from each coefficient FGPGa, FGPGb, is lower than a predetermined concentration;

(f3) the time length between the simultaneous learning routine executed in the previous idling state and the simultaneous learning routine executed in the present idling state is short;

(f4) the sum of the intake air volume during the time between the simultaneous learning routine executed in the previous idling state and the simultaneous learning routine executed in the present idling state is equal to or less than a predetermined value;

(f5) the vehicle is not being accelerated or decelerated in a sudden manner during the period between the simultaneous learning routine executed in the previous idling state and the simultaneous learning routine executed in the present idling state, sudden acceleration and deceleration being checked by monitoring the engine speed, the throttle opening degree, and the depression amount of the gas pedal; and (f6) fluctuations of the coolant temperature THW and the intake air temperature THA are small.

When it is determined that all of conditions (f1) to (f6) are satisfied in step 1204, the CPU 52 proceeds to step 1205. At step 1205, the CPU 52 determines that the fuel vapor concentration was low and barely changed during the above period and thus employs the temporary air-fuel ratio coefficient KGTMP, which was learned during the same period, as the formal air-fuel ratio correction coefficient KG.

If it is determined that any one of conditions (f1) to (f6) is not satisfied in step 1204, the CPU 52 abandons the value KGTMP, which was temporarily learned during the above period. In this case, only the vapor concentration coefficient FGPG renewed during the same period is reflected in the air-fuel ratio control.

The simultaneous learning routine and the temporary air-fuel ratio correction learning routine will now be described with reference to the time chart of FIG. 7.

During period B, the CPU 52 renews the vapor concentration coefficient FGPG of the map section corresponding to the present operating state of the engine 8. During period C, the CPU 52 computes the fuel injection amount TAUf in accordance with the renewed vapor concentration coefficient FGPG and the previous air-fuel ratio correction coefficient KG.

Since the engine 8 is idling in period C, the air-fuel ratio correction coefficient KG and the vapor concentration coefficient FGPG are simultaneously learned in the simultaneous learning routine. The air-fuel ratio correction coefficient rewriting routine is also executed during period C. However, there is no history of the temporary air-fuel ratio correction coefficient learning routine being executed after the commencement of purging. Thus, the conditions for rewriting the air-fuel ratio correction coefficient are not satisfied. Accordingly, the fuel injection amount TAUf during idling is computed based on the simultaneously learned coefficients KG and FGPG through a fuel injection routine, which is shown in FIG. 10.

During period D, the vapor concentration coefficient learning routine is executed to renew the vapor concentration coefficient FGPG, and the temporary air-fuel ratio correction coefficient learning routine is executed to learn the temporary air-fuel ratio correction coefficient KGTMP.

During period E, in which the engine 8 is idling, the simultaneous learning routine is executed once more to simultaneously learn the air-fuel ratio correction coefficient KG and the vapor concentration coefficient FGPG. The air-fuel ratio correction coefficient rewriting routine is executed afterward. During the rewriting routine, due to the execution history of the temporary air-fuel ratio learning routine subsequent to the commencement of purging, the coefficients KGa and FGPGa, which were learned during the previous simultaneous learning routine, are read and compared with KGb and FGPGb, which were learned during the present simultaneous learning routine. If the concentration of the fuel vapor is low and does not change during periods C and D and if the rewriting conditions are satisfied, the CPU 52 rewrites the air-fuel ratio correction coefficient KG with the temporary air-fuel ratio correction coefficient KGTMP. The rewritten air-fuel ratio correction coefficient KG is used when the engine 8 subsequently enters a stable and constant operating state (period F). The coefficients KG, FGPG are compared during period E to confirm whether or not the coefficient FGPG, which is a presumption value, reflects actual conditions.

Accordingly, the air-fuel ratio control apparatus of the first embodiment learns the temporary air-fuel ratio correction coefficient KGTMP when the simultaneous learning is not executed. If the predetermined conditions are satisfied, the temporarily correction coefficient KGTMP is registered as the formal air-fuel ratio correction coefficient KG. As a result, the reduction in the number of renewals of the air-fuel ratio correction coefficient during purging is compensated for. This improves the accuracy of the air-fuel ratio control.

The first embodiment has the advantages described below.

(1) The air-fuel ratio correction coefficient KG and the vapor concentration coefficient FGPG are learned simultaneously and are thus accurate. Accordingly, the air-fuel ratio (learning) control is performed with high accuracy even if purging is being performed.

(2) The temporary air-fuel ratio correction coefficient KGTMP is learned when the engine 8 is not running in a stable and constant manner. If the vapor concentration does not fluctuate when learning the temporary correction coefficient KGTMP, the coefficient KGTMP is used as the air-fuel ratio correction coefficient KG that is reflected in the air-fuel ratio feedback control. This increases the learning opportunities of the air-fuel ratio during purging.

(3) Since learning of the air-fuel ratio is carried out with high precision during purging, the precision of the air-fuel ratio control is improved without decreasing the amount of purged fuel vapor.

In a second embodiment, the first embodiment may be modified as described below.

In the air-fuel ratio correction coefficient rewriting routine of FIG. 14, the rewriting conditions of step 1204 may be altered. For example, the correction coefficient may be rewritten when at least conditions (f1) and (f2) are satisfied.

Processes related to the air-fuel ratio control such as the air-fuel ratio correction coefficient learning routine, the vapor concentration coefficient learning routine, and the simultaneous learning routine may be executed without executing processes related to the rewriting of the air-fuel ratio correction coefficient KG (i.e., the temporary air-fuel ratio correction coefficient learning routine and the air-fuel ratio correction coefficient rewriting routine). Advantage (1) is also obtained in this case.

In equations (IV) and (V), a deviation ΔFAFSM of the grading value of the feedback correction coefficient may be used in lieu of the deviation ΔFAFAV of the feedback correction coefficient average.

An air-fuel ratio control apparatus according to a third embodiment of the present invention will now be described. The air-fuel ratio control apparatus of the third embodiment performs air-fuel ratio control in almost the same manner as the first embodiment. However, the apparatus of the third embodiment executes the simultaneous learning routine in a manner differing from that of the flowchart of FIG. 11. In the third embodiment, the presumption value of the purging rate is corrected in accordance with the fluctuated amount ΔQ of the intake air flow rate Q when tentatively changing the purging rate of the fuel vapor. The coefficients KG and FGPG are computed from the corrected purging rate. By using the corrected purging rate, the air-fuel ratio control in the third embodiment is unaffected by wear or dimensional tolerances of pipes through which the intake air and fuel vapor flows.

Figure 15:
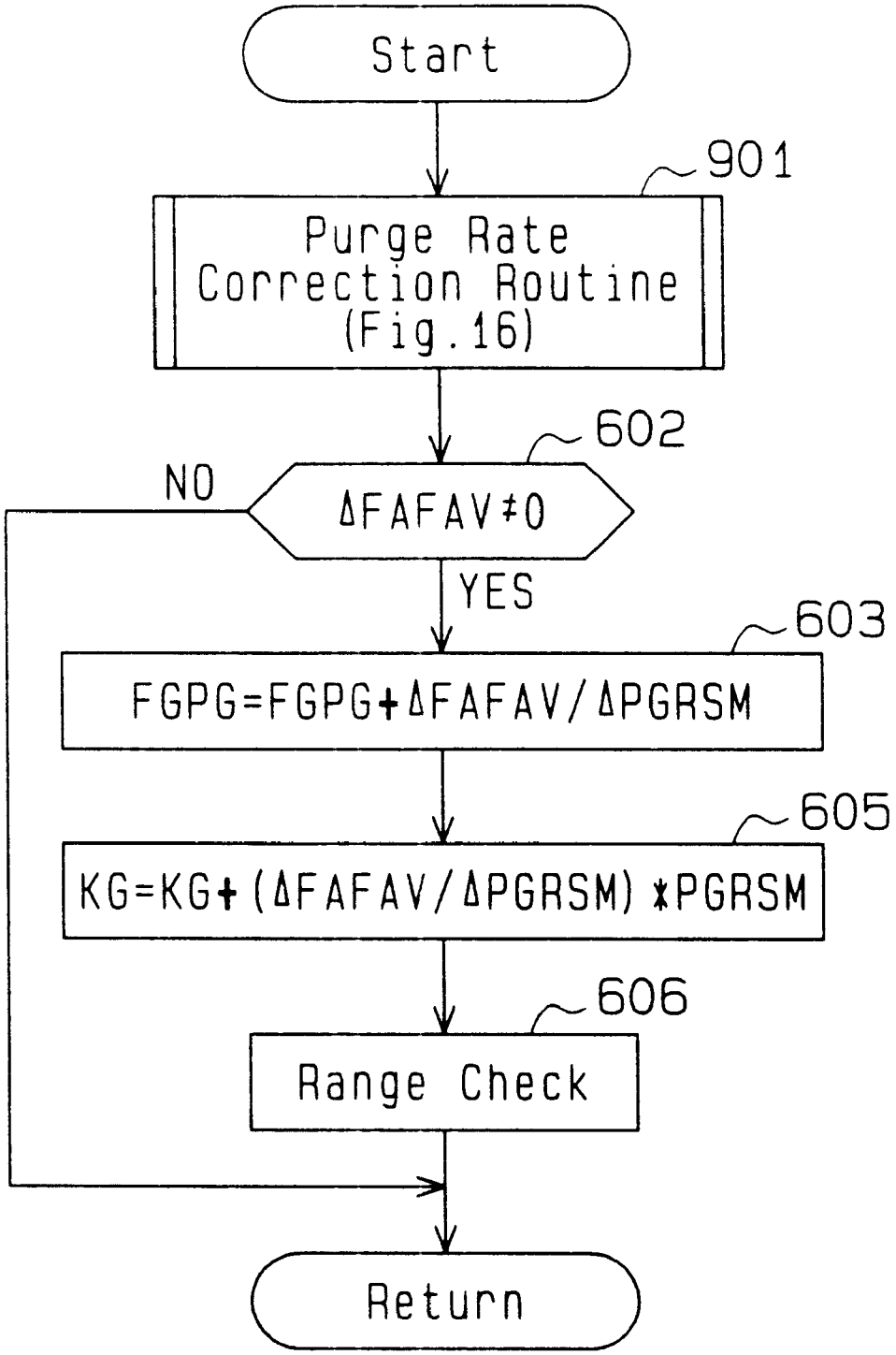
FIG. 15 is a flowchart showing a simultaneous learning control routine of an air-fuel ratio control apparatus according to a third embodiment of the present invention.

FIG. 15 shows the simultaneous learning routine of the third embodiment. The simultaneous learning routine is executed when fuel vapor is purged while the engine 8 is idling.

At step 901, the CPU 52 executes a purging rate correction routine for correcting the deviation between the presumed purging amount, which is computed from the target purging rate PGR, and the actual purging amount.

Figure 16:
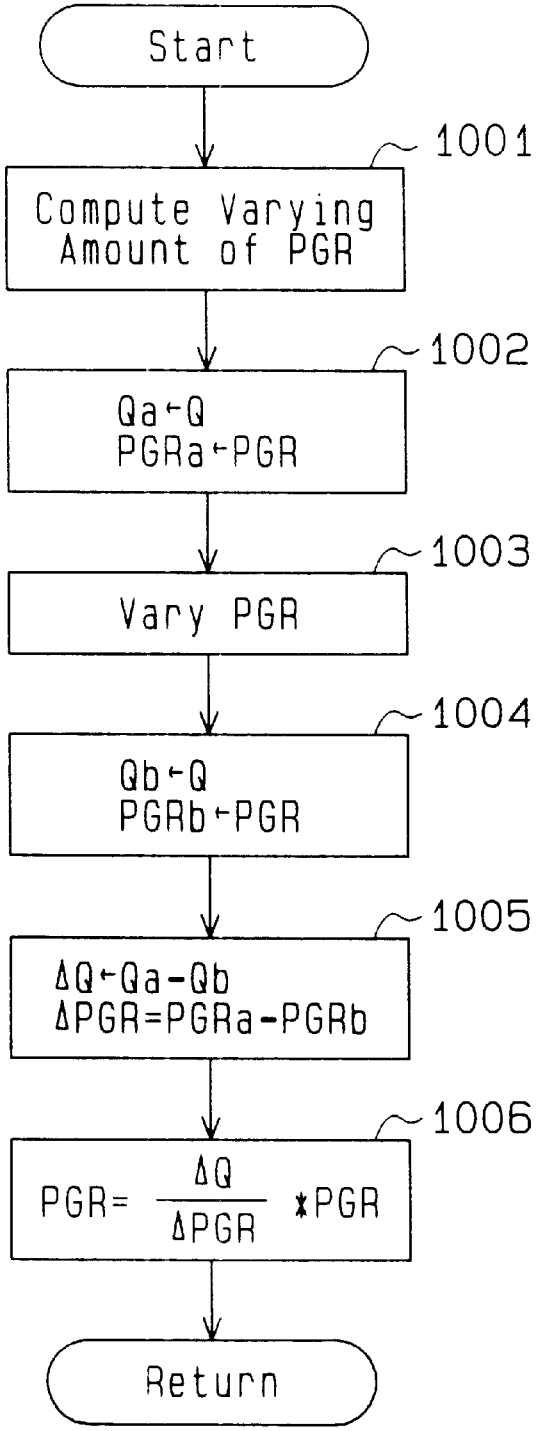
FIG. 16 is a flowchart showing a purge percentage correction control routine of the third embodiment.

The purging rate correction routine will now be described. As shown in FIG. 1, some of the intake air is sent to the canister 14 through the air pipe 17 from the air cleaner 11 and mixed with fuel vapor. The air-fuel-vapor mixture is then purged into the surge tank 10*a* through the purge line 21. In other words, some of the intake air drawn through the air cleaner 11 bypasses the airflow meter 43. Therefore, if the amount of the air drawn through the air cleaner 11 is constant, the amount of air undetected by the airflow meter 43 increases in accordance with the amount of the fuel vapor. This characteristic is used in the purging rate correction routine to correct the presumed purging rate. FIG. 16 is a flowchart showing the purging rate correction routine.

At step 1001, the CPU 52 computes the varying amount of the target purging rate PGR to tentatively change the control duty DPG. At step 1002, the CPU 52 stores the intake air flow rate Q as Qa and the target purging rate PGR as PGRa in the RAM 54. At step 1003, the CPU 52 varies the target purging rate PGR in accordance with the computed varying amount computed in step 1001. This actually changes the opening degree of the purge control valve 22. At step 1004, the CPU 52 stores the varied intake air flow rate Q as Qb and the varied target purging rate PGR as PGRb in the RAM 54. At step 1005, the CPU 52 computes the varied amount (AQ) of the intake air flow rate Q and the varied amount (APGR) of the target purging rate PGR. At step 1006, the CPU 52 corrects the purging rate using equation (VI).

$$[\text{PGR after correction}]=(\Delta Q/\Delta PGR)\times[\text{PGR before correction}] \quad \text{(VI)}$$

In the purging rate correction routine, the target purging rate PGR is changed regardless of the operating state of the engine 8. The varied amount ΔPGR of the target purging rate PGR and the varied amount ΔQ of the intake air flow rate Q are used to correct the target purging rate PGR. The correction results in the presumed target purging rate to reflect the actual purging rate.

After correction of the purging rate, the CPU 52 returns to the simultaneous learning routine shown in FIG. 15. In the steps following step 602, the vapor concentration coefficient FGPG and the air-fuel ratio correction coefficient KG are renewed in accordance with the corrected purging rate PGR. The renewal of these coefficients are carried out in the same manner as the simultaneous learning routine (FIG. 11) of the first embodiment.

In addition to advantages (1) to (3) of the first embodiment, the third embodiment has the advantages described below.

(4) The purging rate is computed accurately by correcting the target purging rate PGR based on the varied amount ΔQ of the of the intake air relative to the varied amount ΔPGR of the purging rate PGR when actually changing the purging rate.

(5) The usage of an accurate purging rate during simultaneous learning of the air-fuel ratio correction coefficient KG and the vapor concentration coefficient FGPG improves the accuracy of the coefficients. This improves the precision of the air-fuel ratio control.

The third embodiment may be modified as described below. The present invention may be applied to a speed density type engine. A speed density type engine employs an absolute pressure sensor in lieu of the airflow meter 43 to detect the amount of intake air. The pressure of the intake passage 10 is detected by the absolute pressure sensor 10 and used to compute the intake air flow rate. The purging rate is corrected from the varied amount of the computed intake air flow rate.

The purging rate corrected through the purging rate correction routine may be used in processes other than the simultaneous learning routine if the fuel injection amount or time is computed. In this case, for example, the correcting rate of the purging rate is registered as a correction coefficient. If a computation that requires the purging rate is performed, the target purging rate PGR is corrected in accordance with the correction coefficient.

Furthermore, for example, if a map divided into a plurality of sections in accordance with the operating state of the engine 8, such as the intake air flow rate Q and the fuel vapor amount, is provided, the purging rate may be corrected in each map section. The deviation between the purging rate, which is presumed from the operating state of the engine 8 and the target purging rate PGR, or the manipulated amount of the purge control valve 22, and the actual purging rate may be varied in accordance with the operating state of the engine 8. The deviation between the presumed purging amount, which is based on the dimensional tolerances in the piping, and the actual purging amount especially depends greatly on the intake air flow rate and the purged fuel vapor amount. Accordingly, the purging rate for each map section, which corresponds to the operating state of the engine 8 or the purging rate of fuel vapor, may be corrected in order to further improve the precision of the air-fuel control.

An air-fuel ratio control apparatus according to a fourth embodiment of the present invention will now be described with the description centering on parts differing from the above embodiments. In the fourth embodiment, the air-fuel ratio correction coefficient KG is renewed even if purging is performed as long as certain conditions are satisfied.

Figure 17:
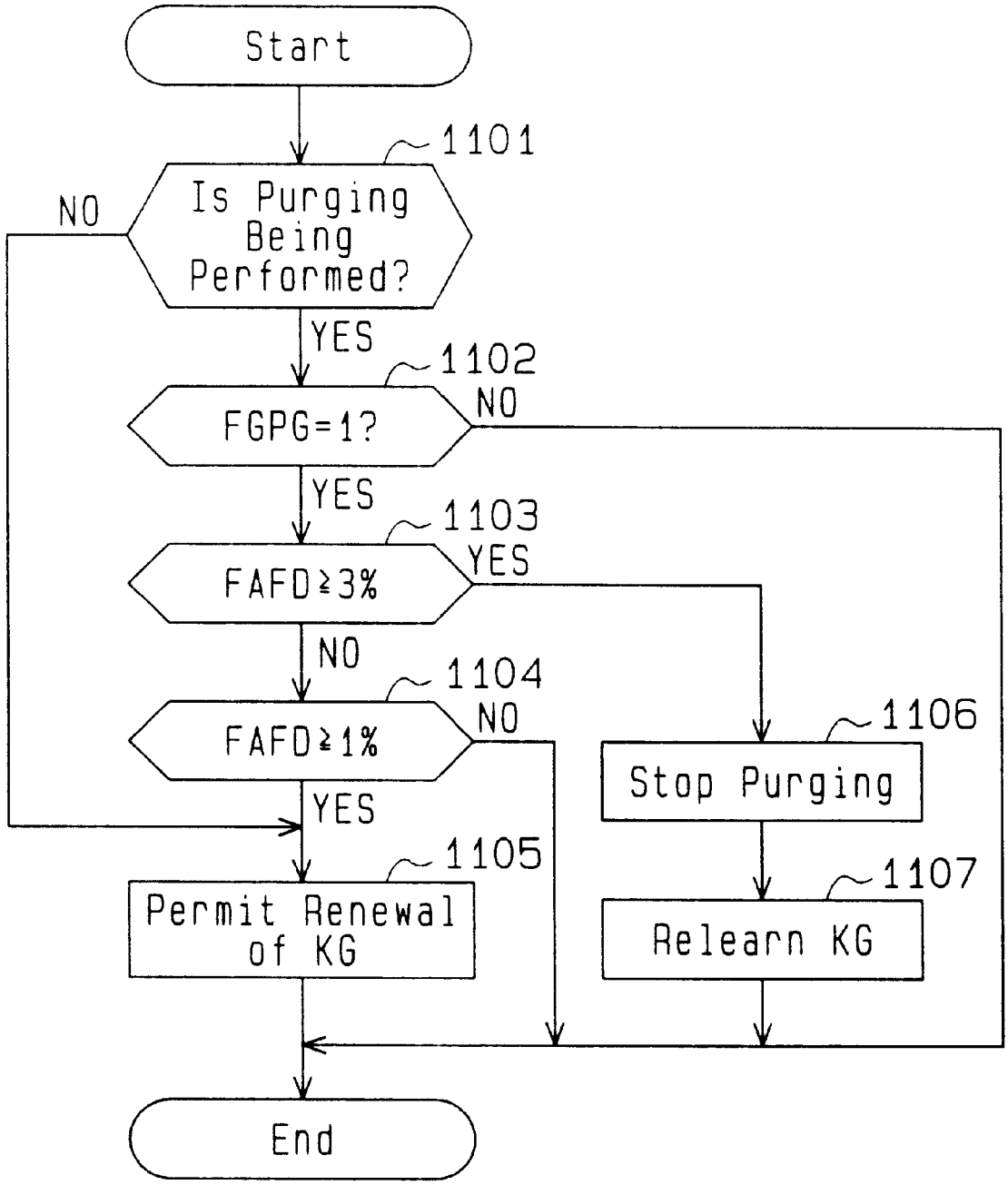
FIG. 17 is a flowchart showing an air-fuel ratio learned value renewing condition judgement routine of an air-fuel ratio control apparatus according to a fourth embodiment of the present invention.

FIG. 17 is a flowchart showing an air-fuel ratio correction coefficient renewing condition judgement routine. This routine is executed once every predetermined time period in an interrupting manner together with the learning control routine of FIG. 6. The results obtained through the judgement routine are reflected in the learning control routine.

At step 1101, the CPU 52 judges whether or not purging is being performed. If it is determined that purging is not being performed, the CPU 52 proceeds to step 1105 and renews the air-fuel ratio correction coefficient in the same manner as the first, second, and third embodiments. If it is determined that purging is being performed, the CPU 52 proceeds to step 1102 and computes the fuel component concentration in the presently purged fuel vapor based on the most recent vapor concentration coefficient FGPG. As apparent from equation (III), if the concentration coefficient FGPG is one, the fuel injection time should be corrected under the presumption that fuel components are not included in the fuel vapor. Accordingly, if it is true that the fuel vapor concentration is zero, the difference in the air-fuel ratio is based on the difference in the air-fuel ratio correction coefficient KG. The CPU 52 thus continues subsequent processing.

If the presumption that the fuel vapor amount is zero is false, that is, if the vapor concentration coefficient FGPG was erroneously learned, fuel corresponding to the fuel vapor amount is erroneously injected from the injectors 7. Thus, when the air-fuel ratio correction coefficient KG is correct, the average FAFAV of the feedback correction coefficient FAF would indicate a rich value (decreasing correction value) to decrease the amount of fuel. In other words, it cannot be judged whether the air-fuel ratio correction coefficient KG or the vapor concentration coefficient FGPG have been erroneously learned as long as the average FAFAV of the feedback correction coefficient FAF is a decreasing correction value. On the other hand, it can be judged that at least the air-fuel ratio correction coefficient KG has been erroneously learned if the average FAFAV of the feedback correction coefficient indicates a lean value (increasing correction value).

If it is determined that the air-fuel ratio correction coefficient FGPG is not equal to one and the fuel concentration of the fuel vapor is thus not zero in step 1102, the CPU 52 terminates the routine and subsequently learns the temporary air-fuel ratio correction coefficient KG while performing purging in the same manner as the first and second embodiments.

If it is determined that the air-fuel ratio correction coefficient FGPG is equal to zero and the fuel concentration of the fuel vapor is thus zero in step 1102, the CPU 52 proceeds to step 1103.

At step 1103, the CPU 52 computes the deviation FAFD of the air-fuel ratio based on the average FAFAV of the air-fuel ratio feedback correction coefficient FAF. If the computed deviation FAFD is equal to or greater than a predetermined value (e.g., 3%), this indicates that the air-fuel ratio correction coefficient KG has deviated from representing actual conditions by a great degree. A greatly deviated air-fuel ratio correction coefficient KG affects the accuracy of the air-fuel ratio control. Thus, the deviation of the correction coefficient KG must be corrected immediately and accurately. Thus, the CPU 52 proceeds to step 1106 and performs purge-cut temporarily. At step 1107, the CPU 52 learns the air-fuel ratio correction coefficient KG again.

If it is determined that the air-fuel ratio deviation FAFD is within a predetermined range (e.g., 1%<FAFD<3%), the CPU 52 proceeds from steps 1103 and 1104 to step 1105. At step 1105, the CPU 52 permits renewal of the air-fuel ratio correction coefficient KG regardless of whether purging is being performed.

During execution of the learning control routine illustrated in FIG. 6, the air-fuel ratio correction coefficient learning routine of step 500 is not executed if purging is being performed. However, in the fourth embodiment, the air-fuel ratio learning routine is performed if the condition of 1%<FAFD<3% is satisfied.

If the offset amount FAFAV is small (e.g., FAFD<1%), the CPU 52 proceeds from step 1103 to step 1104 and then terminates the routine, since the influence of the deviated air-fuel ratio correction coefficient KG can be tolerated. Subsequently, learning of the temporary air-fuel ratio correction coefficient KGTMP is performed.

In addition to advantages (1) to (3) of the first embodiment and advantages (4) and (5) of the third embodiment, the fourth embodiment has the advantages described below.

(6) The air-fuel ratio correction coefficient KG is learned even if purging is performed as long as it is determined that fuel is not included in the fuel vapor and the average FAFAV of the feedback correction coefficient indicates a value that increases the amount of fuel. This increases the opportunities for learning the air-fuel ratio correction coefficient KG and improves the air-fuel ratio control accuracy (7) When the air-fuel ratio correction coefficient has deviated greatly, the air-fuel ratio correction coefficient KG is learned once more. This results in a further improvement of the accuracy of the air-fuel ratio correction coefficient KG.

The fourth embodiment may be modified as described below.

A grading value FAFSM of the feedback correction coefficient FAF may be used as a criterion for renewing the air-fuel ratio correction coefficient KG in lieu of the average FAFAV of the feedback correction value.

In the fourth embodiment, the purge concentration coefficient FGPG is described as being one when fuel components are not included in the fuel vapor. However, the purge concentration coefficient FGPG may take other values when fuel components are not included in the fuel vapor depending on the engine structure or how the fuel injection amount is computed. For example, some types of engine may have a speed tension type intake apparatus while other types may have a mass flow type intake passage in which the opening of the air pipe 17 serves as an air intake port of the canister 14 and is arranged between the throttle valve 14*a* and the airflow meter 43. In such engines, the purge concentration coefficient FGPG corresponding to a state in which the fuel vapor is completely free of fuel components is zero.

It should be apparent to those skilled in the art that the present invention may be embodied in many other specific forms without departing from the spirit or scope of the invention. Particularly, it should be understood that the present invention may be embodied in the following forms.

In each of the above embodiments, the air-fuel ratio correction coefficient KG and the vapor concentration coefficient FGPG are learned simultaneously when the engine 8 is idling. However, simultaneous learning may also be performed in other operating states as long as the engine 8 is running in a stable and constant state. In such state, external factors that affect the air-fuel ratio do not exist.

In each of the above embodiments, air-fuel ratio control is executed by feedback controlling the fuel injection amount (time). However, the learning control executed in each of the above embodiments may also be executed when the air-fuel ratio is controlled by feedback controlling the intake air flow rate.

The present examples and embodiments are to be considered as illustrative and not restrictive, and the invention is not to be limited to the details given herein, but may be modified within the scope and equivalence of the appended claims.

What is claimed is:

1. An air-fuel ratio controller for an internal combustion engine, wherein the controller controls the air-fuel ratio of an air-fuel mixture to be burned according to the running state of the engine, wherein the engine includes an air intake passage connected to a combustion chamber, in which air flows to the combustion chamber, a fuel tank for storing liquid fuel, an injector for supplying the liquid fuel to the combustion chamber, and a fuel vapor supply means for supplying fuel vapor vaporized in the fuel tank to the combustion chamber, the controller comprising:

an air-fuel sensor for detecting the actual air-fuel ratio of the air-fuel mixture;

an air-fuel ratio control means for controlling at least one of the amount of fuel supplied from the injector and the amount of air flowing in the air intake passage;

a primary correcting means for setting a feedback coefficient to correct the difference between the actual air-fuel ratio and a predetermined target air-fuel ratio, wherein the feedback coefficient is feedback controlled; and a secondary correcting means for employing a change of the air-fuel ratio, which is caused by operation of the fuel vapor supplying means in the operation of the air-fuel ratio control means, to correct the difference between the actual air-fuel ratio and the target air-fuel ratio by cooperating with the primary correcting means, wherein the secondary correcting means judges, by referring to the running state and an operating history of the engine, whether to calculate one of an air-fuel ratio correction coefficient related to the difference between the actual air-fuel ratio and the target air-fuel ratio, a concentration coefficient related to the fuel concentration of the fuel vapor and the air-fuel ratio correction coefficient and the concentration coefficient at the same time, and whether to register the actual air-fuel ratio correction coefficient as a temporary value.

2. The air-fuel ratio controller according to claim 1 further comprising:

a vapor amount regulation means for regulating the amount of fuel vapor supplied from the fuel vapor supply means to the air intake passage;

an air-fuel ratio correction coefficient renewing means for renewing the air-fuel ratio correction coefficient;

a concentration coefficient renewing means for renewing the concentration coefficient;

an air-fuel ratio correction coefficient temporary registering means for registering the air-fuel ratio correction coefficient as a temporary value;

a judging means for judging whether the temporary value is usable as the air-fuel ratio correction coefficient; and a simultaneous renewing means for renewing the air-fuel ratio correction coefficient and the concentration coefficient at the same time.

3. The air-fuel ratio controller according to claim 2, wherein the secondary correcting means activates the air-fuel ratio correction coefficient renewing means when the engine is running and fuel vapor is not being supplied.

4. The air-fuel ratio controller according to claim 2, wherein the secondary correcting means activates the simultaneous renewing means during a fuel vapor supply period, during which fuel vapor is supplied by the fuel vapor supply means, and the engine is in a stable operating state during the fuel vapor supply period.

5. The air-fuel ratio controller according to claim 4, wherein the secondary correcting means activates the concentration coefficient renewing means and then activates the air-fuel ratio correction coefficient temporary registering means when the fuel vapor is being supplied and the engine is in a state other than the stable operating state.

6. The air-fuel ratio controller according to claim 5, wherein the secondary correcting means activates the judging means after the next execution of the simultaneous renewing means.

7. The air-fuel ratio controller according to claim 4, wherein the stable operating state includes an idling state.

8. The air-fuel ratio controller according to claim 7, wherein the secondary correcting means activates the concentration coefficient renewing means and then activates the air-fuel ratio correction coefficient temporary registering means when the fuel vapor is being supplied and the engine is in a state other than the idling state.

9. The air-fuel ratio controller according to claim 8, wherein the secondary correcting means activates the judging means after the next execution of the simultaneous renewing means.

10. The air-fuel ratio controller according to claim 2, wherein the concentration coefficient renewing means renews the concentration coefficient when the fuel vapor is being supplied.

11. The air-fuel ratio controller according to claim 2, wherein the air-fuel ratio control means controls at least one of the amount of intake air and the amount of injected fuel based on the feedback coefficient, the air-fuel ratio correction coefficient, the amount of the supplied fuel vapor, and the concentration coefficient.

12. The air-fuel ratio controller according to claim 2, wherein the air-fuel ratio correction coefficient renewing means renews the air-fuel ratio correction coefficient either when no fuel vapor is being supplied or when fuel vapor is being supplied and the engine is idling.

13. The air-fuel ratio controller according to claim 2, wherein the air-fuel ratio correction coefficient temporary registering means registers the air-fuel ratio correction coefficient as a temporary value when fuel vapor is being supplied and the engine is not idling.

14. The air-fuel ratio controller according to claim 13, wherein the judging means compares the last air-fuel ratio correction coefficient and the last concentration coefficient of the last idling state with the air-fuel ratio correction coefficient and the concentration coefficient, respectively, to decide whether to employ the temporary value as the air-fuel ratio correction coefficient when the fuel vapor is supplied continuously and the running state of the engine enters an idling state for a second or subsequent time during a period when fuel vapor is being supplied.

15. The air-fuel ratio controller according to claim 2 further comprising:

a purge ratio calculation means for calculating a volume ratio of the fuel vapor to the intake air based on the operation state of the fuel vapor supply means and the running state of the engine;

a purge ratio correcting means for compensating the calculated volume ratio, wherein the purge ratio correcting means temporary changes the operation state of the fuel vapor supply means during an ordinary running state of the engine, calculates a change ratio of a changed amount of the intake air volume to a changed amount of the calculated purge ratio, wherein the changed amounts result from the temporary change in the operating state of the fuel vapor supply means, and the purge ratio correcting means corrects the volume ratio by multiplying the change ratio by the calculated volume ratio, wherein the secondary correcting means corrects the concentration coefficient calculated by the concentration coefficient renewing means and the air-fuel ratio correction coefficient calculated by the air-fuel ratio correction coefficient renewing means by using the corrected volume ratio after changing the amount of supplied fuel vapor.

16. The air-fuel ratio controller according to claim 15, wherein the secondary correcting means directs the air-fuel ratio correction coefficient renewing means to renew the air-fuel ratio correction coefficient when the following conditions are satisfied regardless of whether fuel vapor is being supplied:

the concentration coefficient is set at a certain value indicating that the fuel concentration of the fuel vapor is zero;

the median of the feedback correction coefficient is set at an enriching value that increases the amount of liquid fuel supplied from the injector; and the median of the feedback correction coefficient is set within a predetermined range.

17. The air-fuel ratio controller according to claim 15, wherein the secondary correcting means temporary stops supplying fuel vapor and directs the air-fuel ratio correction coefficient renewing means to recalculate the air-fuel ratio correction coefficient based on the difference between the actual air-fuel ratio and the target air-fuel ratio when the following conditions are satisfied regardless of whether fuel vapor is being supplied:

the concentration coefficient is set at a certain value indicating that the fuel concentration of the fuel vapor is zero;

the median of the feedback correction coefficient is set at an enriching value that incleases the amount of liquid fuel supplied from the injector; and the median of the feedback correction coefficient is set within a predetermined range.

18. The air-fuel ratio controller according to claim 1, wherein the vapor supply means is a fuel vapor collection container including a valve for releasing fuel vapor from the container.

19. A method for controlling the air-fuel ratio of an air-fuel mixture to be burned according to the running state of an engine, wherein the engine includes a fuel vapor supply apparatus for supplying fuel vapor from a fuel tank to a combustion chamber, the method including:

detecting the actual air-fuel ratio of the air-fuel mixture;

setting a feedback coefficient based on the difference between the actual air-fuel ratio and a predetermined target air-fuel ratio;

judging the running state and an operating history of the engine and the operating state of a fuel vapor supply apparatus;

calculating an air-fuel ratio correction coefficient related to the difference between the actual air-fuel ratio and the target air-fuel ratio;

calculating a fuel concentration-coefficient, which represents the fuel concentration of the fuel vapor;

renewing the air-fuel ratio efficient when the engine is running and fuel vapor is not being supplied;

simultaneously renewing the air-fuel ratio correction coefficient and the concentration coefficient during a fuel vapor supply period, during which fuel vapor is supplied by the fuel vapor supply apparatus, and while the engine is idling for the first time during the fuel vapor supply period;

renewing the concentration coefficient and registering the air-fuel ratio correction coefficient as a temporary value when the fuel vapor is being supplied, and when the engine enters an idling state subsequent to said first time;

judging whether the temporary value is usable as the air-fuel ratio correction coefficient after the next simultaneous renewal of the air-fuel correction coefficient and the concentration coefficient; and controlling at least one of the amount of intake air and the amount of injected fuel based on the feedback coefficient, the air-fuel ratio correction coefficient, the amount of the supplied fuel vapor and the concentration coefficient.

* * * * *